US009285714B2

(12) United States Patent
Kondoh et al.

(10) Patent No.: US 9,285,714 B2
(45) Date of Patent: Mar. 15, 2016

(54) DEVELOPING DEVICE AND IMAGE FORMING APPARATUS AND PROCESS CARTRIDGE INCORPORATING SAME

(71) Applicants: Keinosuke Kondoh, Kanagawa (JP); Kiyonori Tsuda, Kanagawa (JP); Yutaka Takahashi, Kanagawa (JP); Kentaro Mikuniya, Tokyo (JP); Toshio Koike, Tokyo (JP); Emiko Shiraishi, Tokyo (JP)

(72) Inventors: Keinosuke Kondoh, Kanagawa (JP); Kiyonori Tsuda, Kanagawa (JP); Yutaka Takahashi, Kanagawa (JP); Kentaro Mikuniya, Tokyo (JP); Toshio Koike, Tokyo (JP); Emiko Shiraishi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/607,491

(22) Filed: Jan. 28, 2015

(65) Prior Publication Data

US 2015/0227086 A1 Aug. 13, 2015

(30) Foreign Application Priority Data

Feb. 10, 2014 (JP) ..... 2014-023607

(51) Int. Cl.
*G03G 15/09* (2006.01)
*G03G 15/06* (2006.01)

(52) U.S. Cl.
CPC ..... *G03G 15/0921* (2013.01); *G03G 15/065* (2013.01); *G03G 15/0907* (2013.01)

(58) Field of Classification Search
CPC ..... G03G 15/0921; G03G 15/0907
USPC ..... 399/55, 270, 276
See application file for complete search history.

(56) References Cited

U.S. PATENT DOCUMENTS

| | | | | |
|---|---|---|---|---|
| 5,202,731 | A * | 4/1993 | Tanikawa et al. | 399/270 |
| 5,832,350 | A | 11/1998 | Kumasaka et al. | |
| 5,999,762 | A | 12/1999 | Shoji | |
| 6,031,239 | A | 2/2000 | Shi et al. | |
| 6,128,449 | A * | 10/2000 | Zenba et al. | |
| 2003/0118374 | A1 * | 6/2003 | Eun et al. | 399/252 |
| 2008/0181675 | A1 * | 7/2008 | Fujishima et al. | 399/267 |
| 2008/0292365 | A1 * | 11/2008 | Fujishima et al. | 399/285 |

(Continued)

FOREIGN PATENT DOCUMENTS

| | | |
|---|---|---|
| JP | 4-157486 | 5/1992 |
| JP | 4-283774 | 10/1992 |

(Continued)

OTHER PUBLICATIONS

U.S. Appl. No. 14/451,968, filed Aug. 5, 2014.

(Continued)

*Primary Examiner* — Sophia S Chen
(74) *Attorney, Agent, or Firm* — Oblon, McClelland, Maier & Neustadt, L.L.P.

(57) ABSTRACT

A developing device includes a developer bearer to carry, by rotation, developer including toner and magnetic carrier to a development range facing a latent image bearer to bear a latent image. The developer bearer includes a magnetic field generator having multiple magnetic poles and a cylindrical developing sleeve to rotate and bear developer on an outer circumferential surface thereof with magnetic force of the magnetic field generator disposed inside the developing sleeve. The developing sleeve receives development voltage including an AC component having a frequency of 2.0 kHz or lower, and a duty ratio of a component having a polarity opposite a toner normal charge polarity of the AC component is within a range from 4% to 20%.

13 Claims, 17 Drawing Sheets

(56) References Cited

U.S. PATENT DOCUMENTS

| | | | | |
|---|---|---|---|---|
| 2008/0304877 | A1* | 12/2008 | Mori et al. | 399/302 |
| 2009/0003891 | A1* | 1/2009 | Fujishima et al. | 399/284 |
| 2011/0069999 | A1* | 3/2011 | Oba et al. | 399/270 |
| 2012/0243923 | A1* | 9/2012 | Uehara et al. | 399/329 |
| 2012/0269544 | A1 | 10/2012 | Tsuda et al. | |
| 2013/0034368 | A1 | 2/2013 | Hattori et al. | |
| 2013/0322899 | A1* | 12/2013 | Okada | |
| 2014/0133889 | A1 | 5/2014 | Matsumoto et al. | |
| 2014/0248061 | A1 | 9/2014 | Takami et al. | |

FOREIGN PATENT DOCUMENTS

| | | |
|---|---|---|
| JP | 8-286516 | 11/1996 |
| JP | 9-251237 | 9/1997 |
| JP | 10-012431 | 1/1998 |
| JP | 2003-255627 | 9/2003 |
| JP | 2006-178411 | 7/2006 |
| JP | 2010-020281 | 1/2010 |
| JP | 2010-54898 | 3/2010 |
| JP | 2012-168225 | 9/2012 |

OTHER PUBLICATIONS

Extended European Search Report issued Aug. 5, 2015 in Patent Application No. 15152870.0.

* cited by examiner

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2014-023607, filed on Feb. 10, 2014, in the Japan Patent Office, the entire disclosure of which is hereby incorporated by reference herein.

BACKGROUND

1. Technical Field

Embodiments of the present invention generally relate to a developing device, a process cartridge, and an image forming apparatus, such as a copier, a printer, a facsimile machine, or a multifunction peripheral (MFP) having at least two of copying, printing, facsimile transmission, plotting, and scanning capabilities, that includes a developing device.

2. Description of the Related Art

Generally, image forming apparatuses include a developing device to develop latent images formed on a latent image bearer with developer. There are two types of developer: one-component developer including toner and two-component developer including toner and carrier. In high speed image forming apparatuses, two-component development is mainly used to secure a durability thereof. In high speed image forming apparatuses, there are demands for high image quality to cope with commercial printing.

In two-component developing devices, a range where a developing sleeve, serving as a developer bearer, faces the latent image bearer, such as a photoconductor, is called a development range. A magnetic field generator provided inside the developing sleeve generates a magnetic field that causes developer particles to stand on end, in the form of a magnetic brush, on the developing sleeve, and the magnetic brush contacts the latent image bearer in the development range. Thus, toner is supplied to the latent image on the latent image bearer, developing it into a visible image (toner image).

In this type of developing devices, toner borne on the developing sleeve moves toward the latent image bearer due to differences in surface potential between the developing sleeve, to which development voltage is applied, and the latent image bearer. Developing that uses voltage including a direct-current (DC) component is hereinafter referred to as "DC bias development"), and developing that uses voltage including an alternating-current (AC) component (i.e., a superimposed bias in which an AC component is superimposed on a DC component) is hereinafter referred to as "AC bias development".

SUMMARY

An embodiment of the present invention provides a developing device that includes a developer bearer to carry, by rotation, developer including toner and magnetic carrier to a development range facing a latent image bearer to bear a latent image, and the developer bearer includes a magnetic field generator having multiple magnetic poles, and a cylindrical developing sleeve to rotate and bear developer on an outer circumferential surface thereof with magnetic force of the magnetic field generator disposed inside the developing sleeve. The developing sleeve receives development voltage including an AC component having a frequency of 2.0 kHz or lower. In the AC component, a duty ratio of a component having a polarity opposite a toner normal charge polarity is within a range from 4% to 20%.

Another embodiment provides an image forming apparatus that includes a latent image bearer to bear an electrostatic latent image thereon, a charging device to charge the surface of the latent image bearer, the above-described developing device to develop the electrostatic latent image, and a first voltage application device to apply the above-described development voltage to the developing sleeve.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
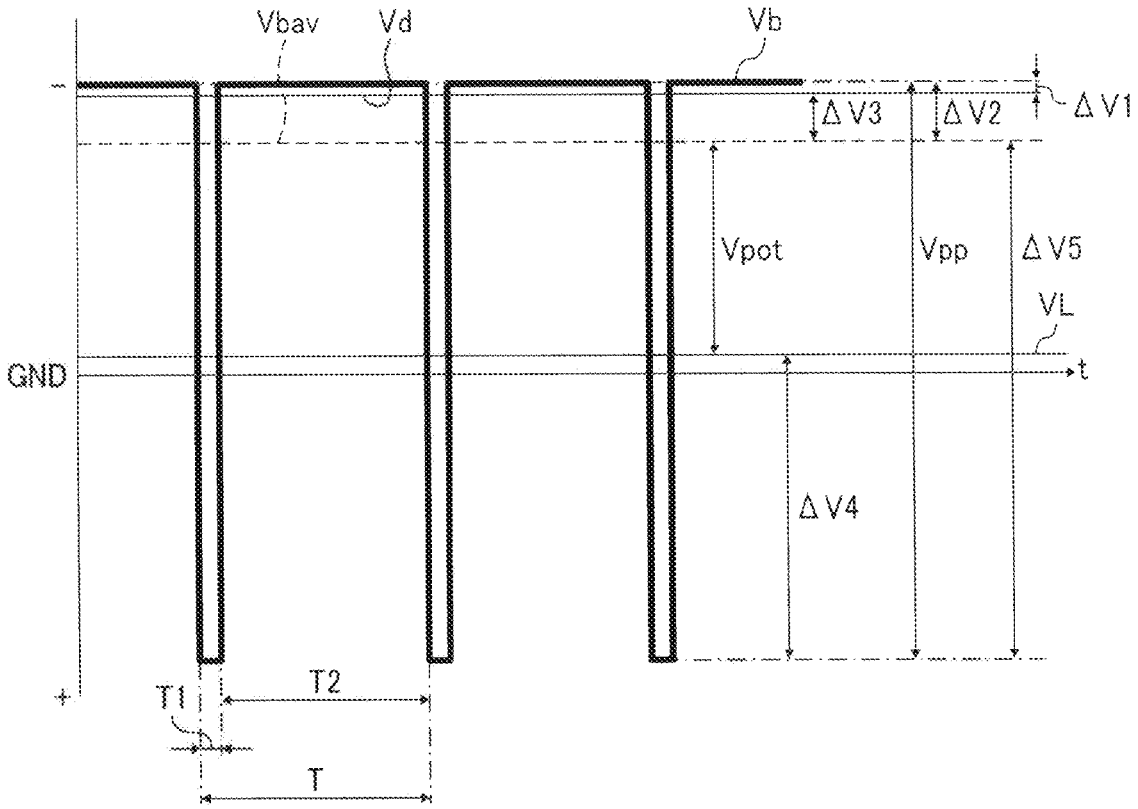
FIG. 1 is a waveform diagram of a developing bias applied to a developing sleeve of a developing device according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The inventors of the present application recognize that the density of images developed in the DC bias development tend to fluctuate cyclically (hereinafter "cyclic density fluctuation") corresponding to a length of circumference (perimeter) of the developing sleeve. The inventors assume that the cyclic density fluctuation is caused as follows. When the developing sleeve is eccentric due to, for example, manufacturing tolerances, a clearance between the latent image bearer and the developing sleeve (i.e., a development gap) fluctuates in accordance with the cycle of rotation of the developing sleeve.

The inventors have confirmed that, in the AC bias development, the above-described cyclic density fluctuation is alleviated compared with the DC bias development, but have found the following inconvenience. Compared with the DC bias development, in typical AC bias development, it is possible that void at density boundaries, which is an image failure defined below, or image graininess is degraded depending on the frequency of AC component. Specifically, void at density boundaries is degraded as the frequency increases, and granularity (graininess) is degraded as the frequency decreases.

The term "void at density boundaries" used in this specification means image failure in which toner is absent at a boundary between portions different in image density. Additionally, "granularity (graininess)" is an item to evaluate how the image looks grainy, and image quality is high when the value of granularity is small.

Figure 2:
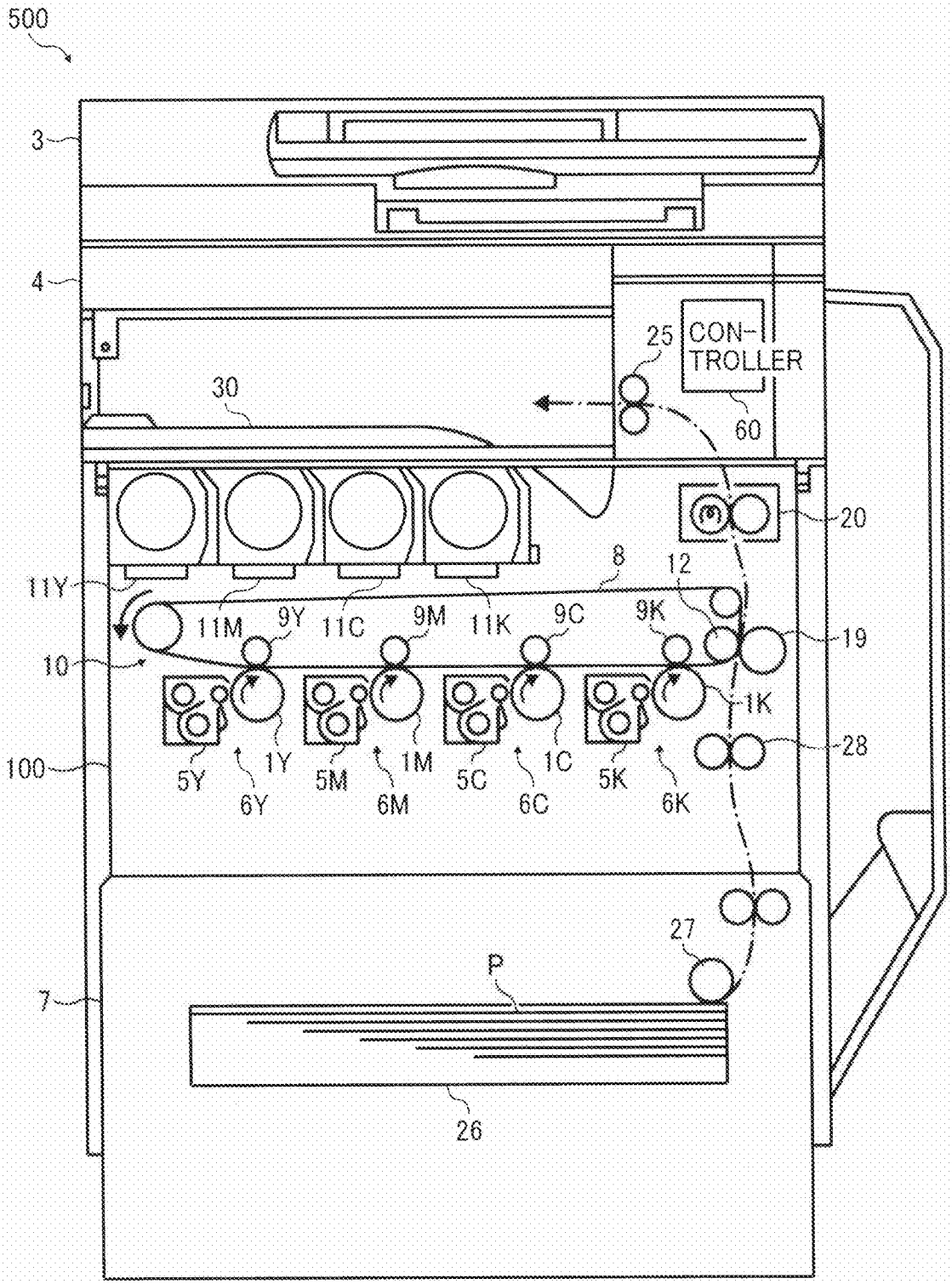
FIG. 2 is a schematic diagram illustrating an image forming apparatus according to an embodiment.

Referring now to the drawings, wherein like reference numerals designate identical or corresponding parts throughout the several views thereof, and particularly to FIG. 2, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 2 is a schematic diagram that illustrates a configuration of an image forming apparatus 500 according to the present embodiment. For example, the image forming apparatus 500 in the present embodiment is a tandem-type multicolor copier.

The image forming apparatus 500 includes a printer unit 100 that is an apparatus body, a document reading unit 4 and a document feeder 3, both disposed above the printer unit 100, and a sheet feeder 7 disposed beneath the printer unit 100. The document feeder 3 feeds documents to the document reading unit 4, and the document reading unit 4 reads image data of the documents. The sheet feeder 7 is a sheet container that contains sheets P (transfer sheets) of recording media and includes a sheet feeding tray 26 in which the sheets P are stored and a sheet feeding roller 27 to feed the sheets P from the sheet feeding tray 26 to the printer unit 100. It is to be noted that broken lines shown in FIG. 2 represent a conveyance path through which the sheet P is transported inside the image forming apparatus 500.

A paper ejection tray 30 on which output images are stacked is provided on an upper side of the printer unit 100. The printer unit 100 includes four image forming units 6Y, 6M, 6C, and 6K for forming yellow, magenta, cyan, and black toner images, respectively, and an intermediate transfer unit 10. Each image forming unit 6 includes a drum-shaped photoconductor 1 serving as an image bearer on which a toner image is formed, and a developing device 5 for developing an electrostatic latent image on the photoconductor 1 into the toner image.

The image forming units 6Y, 6M, 6C, and 6K respectively corresponding to yellow, magenta, cyan, and black are arranged in parallel, facing an intermediate transfer belt 8 of an intermediate transfer unit 10.

The intermediate transfer unit 10 includes four primary-transfer bias rollers 9Y, 9M, 9C, and 9K in addition to the intermediate transfer belt 8. The intermediate transfer belt 8 serves as an intermediate transfer member onto which the toner images are transferred from the respective photoconductors 1, and the toner images are superimposed one on another thereon, thus forming a multicolor toner image. The primary-transfer bias rollers 9 serve as primary-transfer members to primarily transfer the toner images from the photoconductors 1 onto the intermediate transfer belt 8.

The printer unit 100 further includes a secondary-transfer bias roller 19 to transfer the multicolor toner image from the intermediate transfer belt 8 onto the sheet P. Further, a pair of registration rollers 28 is provided to suspend the transport of the sheet P and adjust the timing to transport the sheet P to a secondary-transfer nip between the intermediate transfer belt 8 and the secondary-transfer bias roller 19 pressed against it. The printer unit 100 further includes a fixing device 20 disposed above the secondary-transfer nip to fix the toner image on the sheet P.

Additionally, toner containers 11Y, 11M, 11C, and 11K for containing respective color toners supplied to the developing devices 5 are provided inside the printer unit 100, beneath the paper ejection tray 30 and above the intermediate transfer unit 10.

The image forming apparatus 500 further includes a controller 60, which is, for example, a computer including a central processing unit (CPU) and associated memory units (e.g., ROM, RAM, etc.). The computer performs various types of control processing by executing programs stored in the memory. Field programmable gate arrays (FPGA) may be used instead of CPUs.

Figure 3:
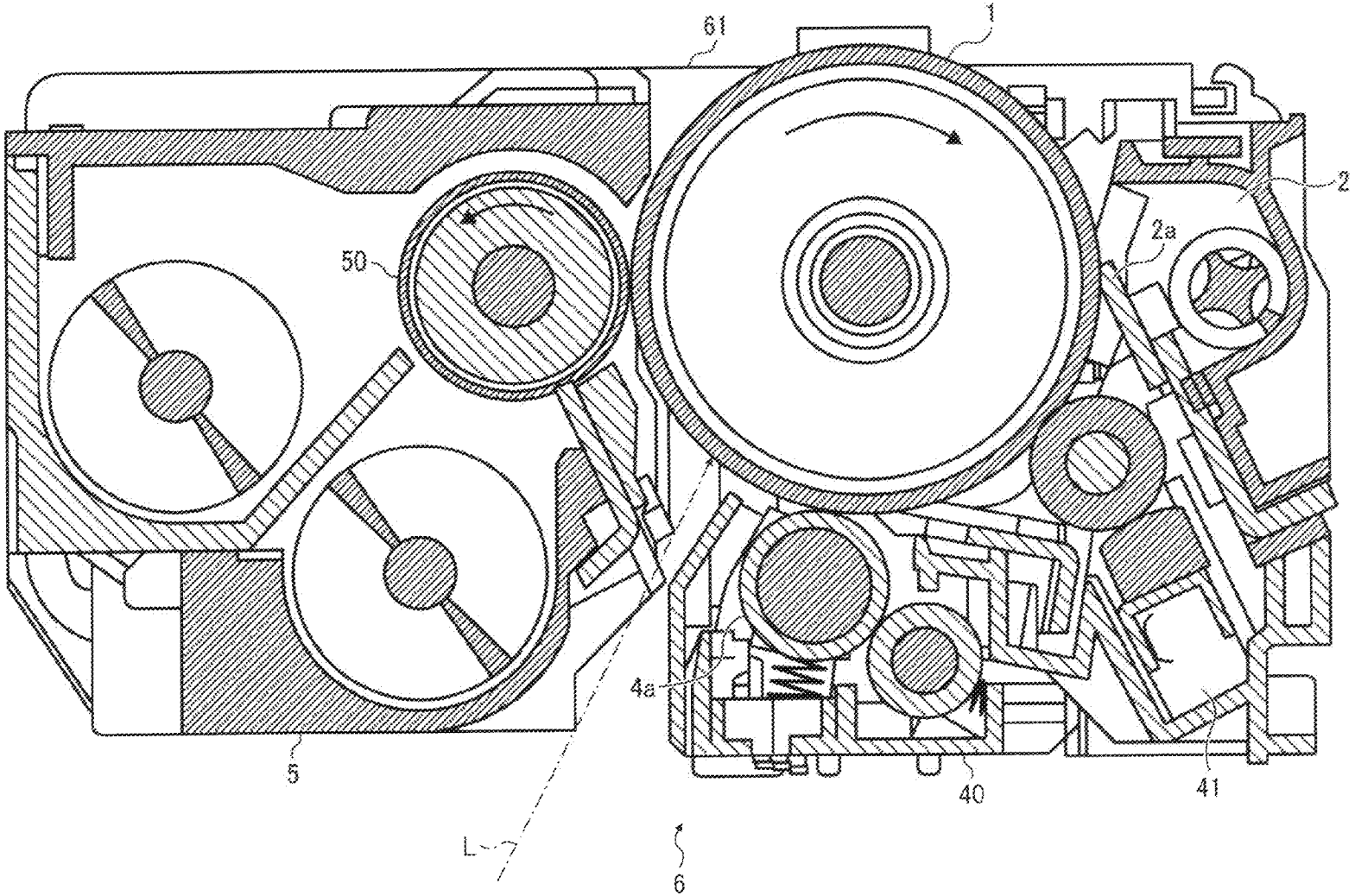
FIG. 3 is a schematic end-on axial view of an image forming unit of the image forming apparatus shown in FIG. 2.

FIG. 3 is an enlarged view of one of the four image forming units 6. The four image forming units 6 have a similar configuration except the color of toner used therein, and hereinafter the suffixes Y, M, C, and K may be omitted when color discrimination is not necessary.

As shown in FIG. 3, the image forming unit 6 includes the developing device 5, a cleaning device 2, a lubrication device 41, and a charging device 40 arranged in that order around the photoconductor 1. It is to be noted that, in FIG. 2, only the developing device 5 is illustrated around the photoconductor 1. In the image forming unit 6 according to the present embodiment, the cleaning device 2 employs a cleaning blade 2*a*, and the charging device 40 employs a charging roller 4*a*.

In the configuration shown in FIG. 3, the image forming unit 6 includes a common unit casing 61 to support the photoconductor 1, the charging device 40, the developing device 5, and the cleaning device 2 and these components are united into a modular unit (i.e., a process cartridge or process unit) removably installable in the image forming apparatus 500. This configuration can facilitate replacement of the developing device 5 in the apparatus body, thus facilitating maintenance work.

In another embodiment, the photoconductor 1 and the developing device 5 are united into a modular unit serving as a process cartridge. In yet another embodiment, the photoconductor 1, the charging device 40, the developing device 5, and the cleaning device 2 are independently installed and removed from the apparatus body. Each of them is replaced with a new one when its operational life expires.

In image formation, toner images are formed on the photoconductor 1 through image forming processes, namely, charging, exposure, development, transfer, and cleaning processes.

Operations of the image forming apparatus 500 to form multicolor images are described below.

When a start button is pressed with documents set on a document table of the document feeder 3, conveyance rollers provided in the document feeder 3 transport the documents from the document table onto an exposure glass (contact glass) of the document reading unit 4. Then, the document reading unit 4 reads image data of the document set on the exposure glass optically.

More specifically, the document reading unit 4 scans the image of the document on the exposure glass with light emitted from an illumination lamp. The light reflected from the surface of the document is imaged on a color sensor via mirrors and lenses. The multicolor image data of the document is decomposed into red, green, and blue (RGB), read by the color sensor, and converted into electrical image signals. Further, an image processor performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to an exposure device. The exposure device directs laser beams L to respective surfaces of the photoconductors 1 according to image data of respective colors.

Meanwhile, the four photoconductors 1 are rotated by a driving motor clockwise in FIGS. 2 and 3. The surface of the photoconductor 1 is charged uniformly at a position facing the charging roller 4*a* of the charging device 40 (a charging process). Thus, charge potential is given to the surface of each photoconductor 1. Subsequently, the surface of the photoconductor 1 thus charged reaches a position to receive the laser beam L emitted from the exposure device.

Then, the laser beams L according to the respective color image data are emitted from four light sources of the exposure device. The laser beams pass through different optical paths for yellow, magenta, cyan, and black and reach the surfaces of the respective photoconductors 1 (an exposure process).

In the case of yellow, the laser beam L corresponding to the yellow component is directed to the photoconductor 1Y, which is the first from the left in FIG. 2 among the four photoconductors 1. A polygon mirror that rotates at high velocity deflects the laser beam L for yellow in a direction of a rotation axis of the photoconductor 1Y (main scanning direction) so that the laser beam L scans the surface of the photoconductor 1Y. With the scanning of the laser beam L, an electrostatic latent image for yellow is formed on the photoconductor 1Y charged by the charging device 40.

Similarly, the laser beam L corresponding to the magenta component is directed to the surface of the photoconductor 1M, which is the second from the left in FIG. 2, thus forming an electrostatic latent image for magenta thereon. The laser beam L corresponding to the cyan component is directed to the surface of the photoconductor 1C, which is the third from the left in FIG. 2, thus forming an electrostatic latent image for cyan thereon. The laser beam L corresponding to the black component is directed to the surface of the photoconductor 1K, which is the fourth from the left in FIG. 2, thus forming an electrostatic latent image for black thereon.

Subsequently, the surface of the photoconductor 1 bearing the electrostatic latent image is further transported to the position facing the developing device 5. At that position, the developing device 5 to contain developer including toner (toner particles) and carrier (carrier particles) supplies toner to the surface of the photoconductor 1, thus developing the latent image thereon (a development process). Then, a toner image is formed on the photoconductor 1.

Subsequently, the surfaces of the photoconductors 1 reach positions facing the intermediate transfer belt 8, where the primary-transfer bias rollers 9 are provided in contact with an inner circumferential face of the intermediate transfer belt 8 The primary-transfer bias rollers 9 face the respective photoconductors 1 via the intermediate transfer belt 8, and contact portions therebetween are called primary-transfer nips, where the single-color toner images are transferred from the respective photoconductors 1 and superimposed one on another on the intermediate transfer belt 8 (a transfer process). After the primary-transfer process, a slight amount of toner tends to remain untransferred on the photoconductor 1.

Subsequently, the surface of the photoconductor 1 reaches a position facing the cleaning device 2, where the cleaning blade 2*a* scraps off the untransferred toner on the photoconductor 1 (cleaning process).

Subsequently, a discharger removes electrical potential remaining on the surface of the photoconductor 1.

Thus, a sequence of image forming processes performed on the photoconductor 1 is completed, and the photoconductor 1 is prepared for subsequent image formation.

The image forming units 6 shown in FIG. 2 perform the above-described image forming processes, respectively. That is, the exposure device disposed beneath the image forming units 6 in FIG. 2 directs laser beams L according to image data onto the photoconductors 1 in the respective image forming units 6. Specifically, the exposure device includes light sources to emit the laser beams L, multiple optical elements, and a polygon mirror that is rotated by a motor. The exposure device directs the laser beams L to the respective photoconductors 1 via the multiple optical elements while deflecting the laser beams L with the polygon mirror. Then, the toner images formed on the respective photoconductors 1 through the development process are transferred therefrom and superimposed one on another on the intermediate transfer belt 8. Thus, a multicolor toner image is formed on the intermediate transfer belt 8.

As described above, the four primary-transfer bias rollers 9 press against the corresponding photoconductors 1 via the intermediate transfer belt 8, and four contact portions between the primary-transfer bias rollers 9 and the corresponding photoconductors 1 are hereinafter referred to as primary-transfer nips. Each primary-transfer bias roller 9 receives a transfer bias whose polarity is opposite the charge polarity of the toner.

While rotating in a direction indicated by an arrow shown in FIG. 2, the intermediate transfer belt 8 sequentially passes through the respective primary-transfer nips. Then, the single-color toner images are transferred from the respective photoconductors 1 primarily and superimposed one on another on the intermediate transfer belt 8.

The intermediate transfer belt 8 carrying the superimposed single-color toner images (a multicolor toner image) transferred from the four photoconductors 1 rotates counterclockwise in FIG. 2 and reaches a position facing the secondary-transfer bias roller 19. A secondary-transfer backup roller 12 and the secondary-transfer bias roller 19 press against each other via the intermediate transfer belt 8, and the contact portion therebetween is the secondary-transfer nip.

Additionally, the sheet feeding roller 27 sends out the sheet P from the sheet feeding tray 26, and the sheet P is then guided by a sheet guide to the registration rollers 28. The sheet P is caught in the nip between the registration rollers 28 and stopped. Then, the registration rollers 28 forward the sheet P to the secondary-transfer nip, timed to coincide with the multicolor toner on the intermediate transfer belt 8.

More specifically, the sheet feeding tray 26 contains multiple sheets P (i.e., transfer sheets) serving as recording media and piled one on another. The sheet feeding roller 27 rotates counterclockwise in FIG. 2 to feed the sheet P on the top contained in the sheet feeding tray 26 toward a nip between the registration rollers 28. The registration rollers 28 stop rotating temporarily, stopping the sheet P with a leading edge of the sheet P stuck in the nip therebetween. The registration rollers 28 resume rotation to transport the sheet P to the secondary-transfer nip, timed to coincide with the arrival of the multicolor toner image on the intermediate transfer belt 8.

In the secondary-transfer nip, the multicolor toner image is transferred from the intermediate transfer belt 8 onto the sheet P (a secondary-transfer process). A slight amount of toner tends to remain untransferred on the intermediate transfer belt 8 after the secondary-transfer process.

Subsequently, the intermediate transfer belt 8 reaches a position facing a belt cleaning device, where the untransferred toner on the intermediate transfer belt 8 is collected by the belt cleaning device. Thus, a sequence of transfer processes performed on the intermediate transfer belt 8 is completed. Thus, a sequence of image forming processes performed on the intermediate transfer belt 8 is completed.

The sheet P carrying the multicolor toner image is sent to the fixing device 20. In the fixing device 20, a fixing belt and a pressing roller are pressed against each other. In a fixing nip therebetween, the toner image is fixed on the sheet P with heat and pressure (i.e., a fixing process).

Then, the sheet P is transported by a pair of paper ejection rollers 25, discharged outside the apparatus body as an output image, and stacked on the paper ejection tray 30 sequentially.

Thus, a sequence of image forming processes performed in the image forming apparatus 500 is completed.

Next, a configuration and operation of the developing device 5 of the image forming unit 6 are described in further detail below with reference to FIGS. 4 through 6C.

Figure 4:
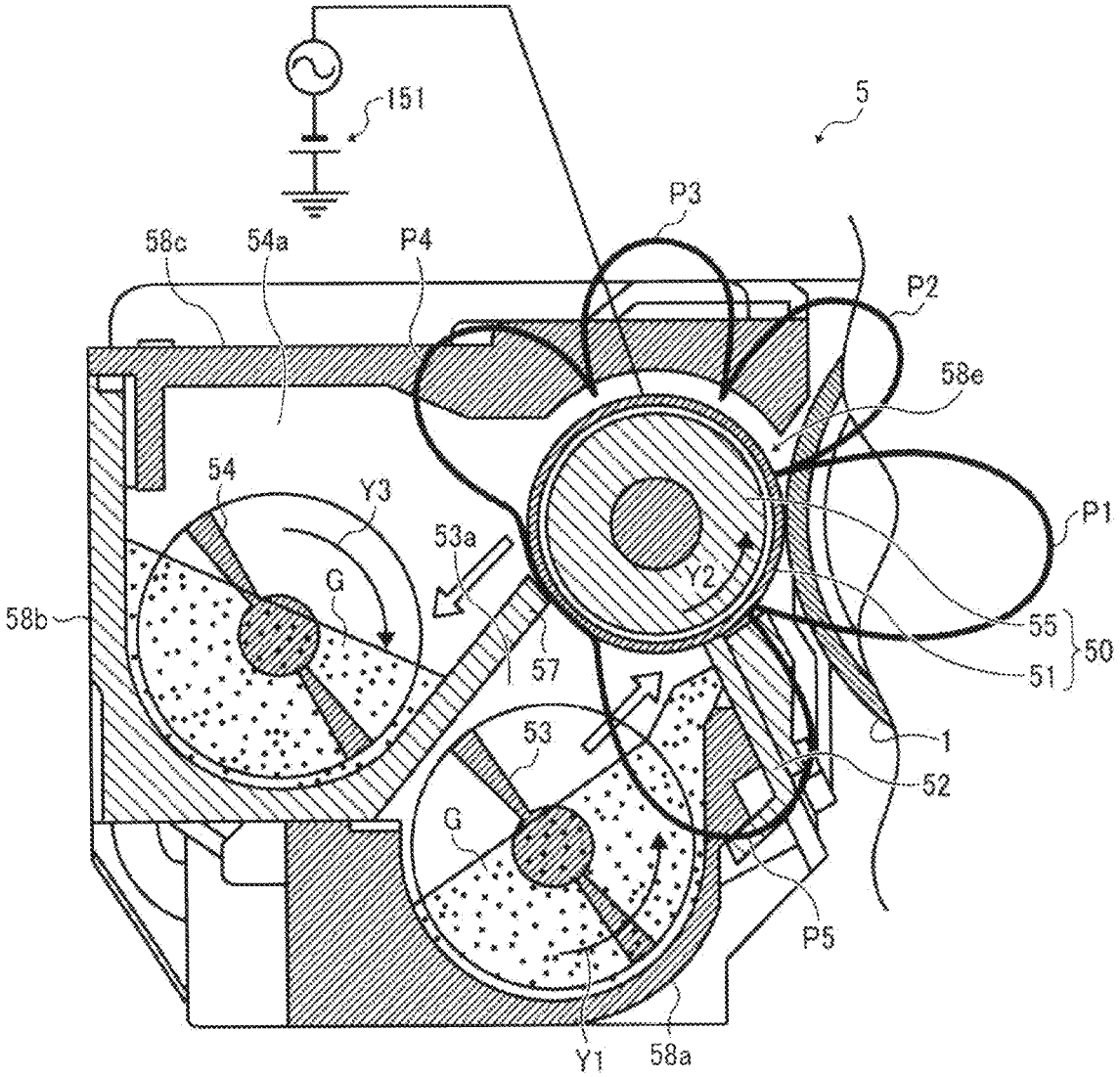
FIG. 4 is an end-on axial view of a developing device according to an embodiment.

FIG. 4 is an end-on axial view of the developing device 5 according to the present embodiment. It is to be noted that reference character G shown in FIG. 4 represents developer contained in the developing device 5, but the reference character G is omitted in the specification.

The developing device 5 includes a casing 58 (shown in FIG. 5) to contain developer. The casing 58 includes a lower case 58*a*, an upper case 58*b*, and a development cover 58*c*.

Figure 5:
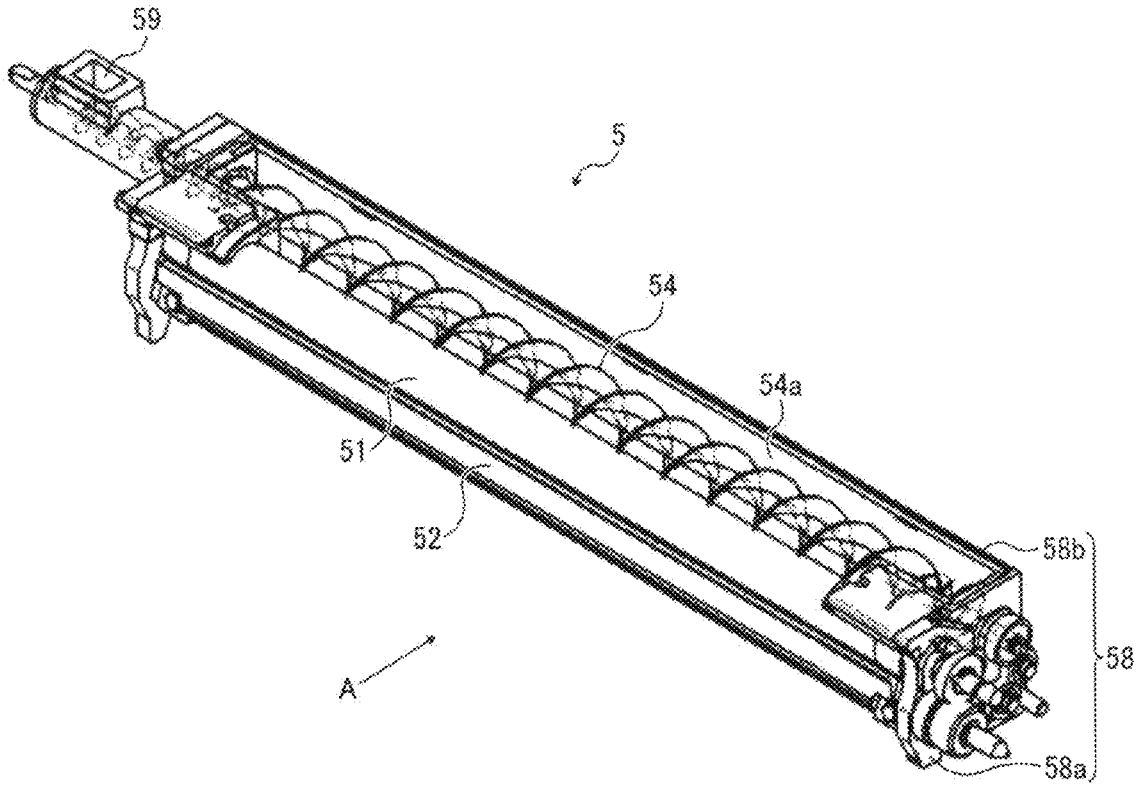
FIG. 5 is a perspective view of the developing device shown in FIG. 4, from which a development cover is removed.

FIG. 5 is a perspective view illustrating the developing device 5 from which the development cover 58*c* is removed.

Figure 6A:
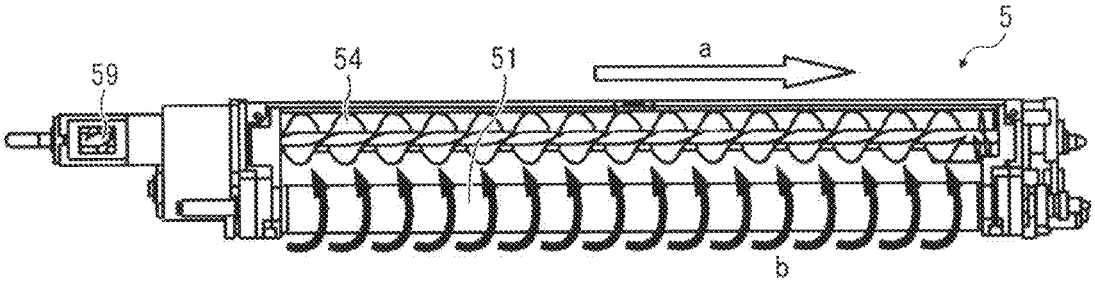
FIG. 6A is a top view of the developing device shown in FIG. 5, from which the development cover is removed.
Figure 6B:
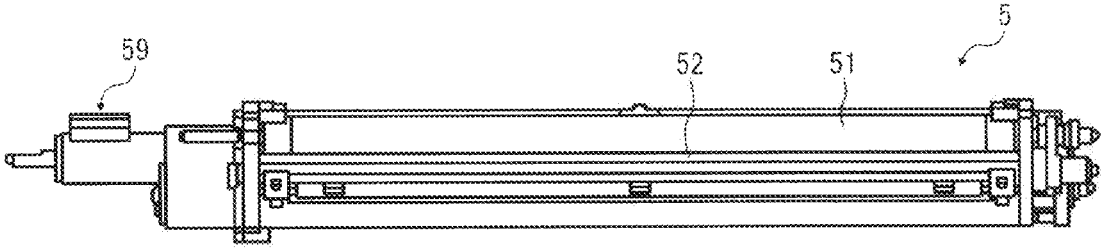
FIG. 6B is a side view of the developing device shown in FIG. 5.
Figure 6C:
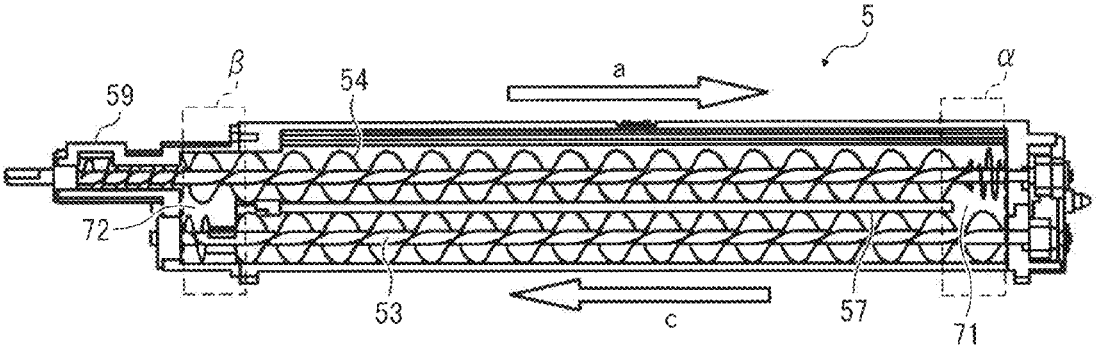
FIG. 6C is a cross-sectional view of the developing device shown in FIG. 5.

FIG. 6A is a top view of the developing device 5 from which the development cover 58*c* is removed, FIG. 6B is a side view of the developing device 5 as viewed in the direction indicated by arrow A shown in FIG. 5. FIG. 6C is a cross-sectional view of the developing device 5 as viewed in the direction indicated by arrow A shown in FIG. 5.

The developing device 5 includes a developing roller 50 serving as a developer bearer disposed facing the photoconductor 1, a supply screw 53, a collecting screw 54, a doctor blade 52 serving as a developer regulator, and a partition 57. In one embodiment, the supply screw 53 and the collecting screw 54 are screws or augers each including a rotation shaft and a spiral blade winding around the rotation shaft and transport developer in an axial direction by rotating. In another embodiment, the supply screw 53 and the collecting screw 54 are paddles.

The casing 58 includes a development opening 58*e* to partly expose the surface of the developing roller 50 in a development range where the developing roller 50 faces the photoconductor 1.

The doctor blade 52 is disposed facing the surface of the developing roller 50 and adjusts the amount of developer carried on the surface of the developing roller 50.

The supply screw 53 and the collecting screw 54 serve as multiple developer conveying members to stir and transport developer in the longitudinal direction, thereby establishing a circulation channel. The supply screw 53 faces the developing roller 50 and supplies developer to the developing roller 50 while transporting the developer in the longitudinal direction. The collecting screw 54 transports developer while mixing the developer with supplied toner.

The partition 57 divides, at least partly, an interior of the casing 58 into a supply channel 53*a* in which the supply screw 53 is provided and a collecting channel 54*a* in which the collecting screw 54 is provided. Additionally, on the cross section (shown in FIG. 4) perpendicular to the axial direction, an end face of the partition 57 faces the developing roller 50 and positioned adjacent to the developing roller 50. Thus, the partition 57 also serves as a separator to facilitate separation of developer from the surface of the developing roller 50. The partition 57 has a separating capability to inhibit the developer that has passed through the development range, carried on the developing roller 50, from reaching the supply channel 53*a*. Thus, the developer is not retained but moves to the collecting channel 54*a*.

As shown in FIG. 4, the developing roller 50 includes a magnet roller 55 including multiple stationary magnets and a developing sleeve 51 that rotates around the magnet roller 55. The developing sleeve 51 is a rotatable, cylindrical member made of or including a nonmagnetic material. The magnet roller 55 is housed inside the developing sleeve 51. The magnet roller 55 generates, for example, five magnetic poles, first through fifth poles P1 through P5. The first and third poles P1 and P3 are south (S) poles, and the second, fourth, and fifth poles P2, P4, and P5 are north (N) poles, for example. As the developing sleeve 51 rotates around the magnet roller 55 in which the multiple magnetic poles are formed, developer moves in the circumferential direction (in the direction of arc) of the developing roller 50. It is to be noted that bold petal-like lines with reference characters P1 through P5 in FIG. 4 represent density distribution (absolute value) of magnetic flux generated by the respective magnetic poles on the developing sleeve 51 in a direction normal to the surface of the developing sleeve 51.

The developing device 5 contains two-component developer including toner and carrier (one or more additives may be included) in a space (e.g., the supply channel 53*a* and the collecting channel 54*a*) defined by the casing 58. The supply screw 53 and the collecting screw 54 transport developer in the longitudinal direction (an axial direction of the developing sleeve 51), and thus the circulation channel is established inside the developing device 5. Additionally, the supply screw 53 and the collecting screw 54 are arranged vertically, that is, disposed adjacent to each other at different heights. The partition 57 situated between the supply screw 53 and the collecting screw 54 divides the supply channel 53*a* from the collecting channel 54*a*. The developing device 5 further includes a toner density detector to detect the density of toner in developer contained in the supply channel 53*a* or the collecting channel 54*a*.

The doctor blade 52 is provided beneath the developing roller 50 in FIG. 4 and upstream in the direction indicated by arrow Y2 in FIG. 4, in which the developing sleeve 51 rotates, from the development range where the developing roller 50 faces the photoconductor 1. The doctor blade 52 adjusts the amount of developer conveyed to the development range, carried on the developing sleeve 51.

Further, a toner supply inlet 59 (shown in FIG. 5) is in the developing device 5 to supply toner to the developing device 5 in response to consumption of toner because two-component developer is used in the present embodiment. While being transported, the supplied toner is stirred and mixed with the developer exiting in the developing device 5 by the collecting screw 54 and the supply screw 53. The developer thus stirred is partly supplied to the surface of the developing sleeve 51 serving as the developer bearer and carried thereon. After the doctor blade 52 disposed beneath the developing sleeve 51 adjusts the amount of developer carried on the developing sleeve 51, the developer is transported to the development range. In the development range, the toner in developer on the developing sleeve 51 adheres to the latent image on the surface of the photoconductor 1.

In the developing device 5 according to the present embodiment, a constant or substantially constant amount of developer is contained. For example, in the developer usable in the present embodiment, toner particles, including polyester resin as a main ingredient, and magnetic carrier particles, are mixed uniformly so that the density of toner is about 7% by weight. The toner has an average particle diameter of about 5.8 μm, and the magnetic carrier has an average particle diameter of about 35 μm, for example. The supply screw 53 and the collecting screw 54 arranged in parallel are rotated at a velocity of about 600 to 800 revolutions per minute (rpm), thereby transporting developer while mixing toner and carrier, charging the toner. Additionally, the toner supplied through the toner supply inlet 59 is stirred in the developer by rotating the supply screw 53 and the collecting screw 54 to make the content of toner in the developer uniform.

While being transported in the longitudinal direction by the supply screw 53 positioned adjacent to and parallel to the developing sleeve 51, the developer in which toner and carrier are mixed uniformly is attracted by the fifth pole P5 of the magnet roller 55 inside the developing sleeve 51 and carried on the outer circumferential surface of the developing sleeve 51. The developer carried on the developing sleeve 51 is transported to the development range as the developing sleeve 51 rotates counterclockwise as indicated by an arrow shown in FIG. 4.

The developing sleeve 51 receives voltage from a power source 151 shown in FIG. 4, and thus a development field (electrical field) is generated between the developing sleeve 51 and the photoconductor 1 in the development range. With the development field, the toner in developer carried on the surface of the developing sleeve 51 is supplied to the latent image on the surface of the photoconductor 1, developing it.

The developer on the developing sleeve 51 that has passed through the development range is collected in the collecting channel 54*a* as the developing sleeve 51 rotates. Specifically, developer falls from the developing sleeve 51 to an upper face of the partition 57, slides down the partition 57, and then is collected by the collecting screw 54.

Inside the developing device 5, developer flows as indicated by arrows shown in FIGS. 6A and 6C. Specifically, arrow a indicates the flow of developer (i.e., a developer conveyance direction) transported in the collecting channel 54*a* by the collecting screw 54. Arrow b shown in FIG. 6A indicates the flow of developer carried onto the developing sleeve 51 and transported to the collecting channel 54*a*, and arrow c in the FIG. 6C indicates the flow of developer transported inside the supply channel 53*a* by the supply screw 53.

The collecting channel 54*a* on the upper side and the supply channel 53*a* on the lower side in FIG. 6C communicate with each other in end areas α and β in the axial direction of the supply screw 53 and the collecting screw 54. The end area α is on the downstream side in the direction indicated by arrow a in which the collecting screw 54 transports developer, and the end area β is on the downstream side in the direction indicated by arrow c in which the supply screw 53 transports developer. Developer is transported down from the collecting channel 54*a* to the supply channel 53*a* in the end area α and transported up from the supply channel 53*a* to the collecting channel 54*a* in the end area β. In the end areas α and β, which are communicating portions, the supply screw 53 and the collecting screw 54 are varied in shape to exert a capability to transport developer in a direction perpendicular to the conveyance directions indicated by arrows a and c. For example, a paddle or a reversed spiral blade is provided to portions of these screws facing the end areas α and β.

Figure 7:
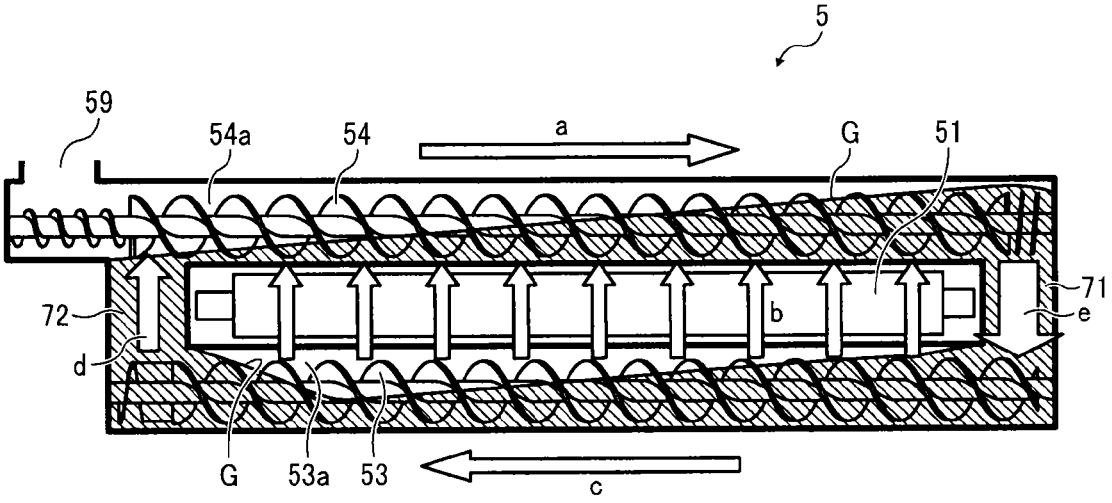
FIG. 7 is a schematic diagram illustrating movement of developer and an accumulation state of developer in the longitudinal direction (axial direction) inside the developing device shown in FIG. 5.

FIG. 7 is a schematic diagram illustrating movement of developer and an accumulation state of developer in the longitudinal direction (the axial direction) inside the developing device 5. In FIG. 7, outlined arrows a and c indicate the flow of developer in the developing device 5. Although the partition 57 is omitted in FIG. 7 for simplicity, as shown in FIG. 6C, openings (a developer-falling opening 71 and a developer-lifting opening 72) are in end portions of the partition 57 in the longitudinal direction of the developing device 5. Through the openings, the supply channel 53*a* communicates with the collecting channel 54*a*.

As shown in FIG. 7, at the downstream end of the supply channel 53*a* in the direction in which developer is transported by the supply screw 53, developer is transported up, as indicated by arrow d, through the developer-lifting opening 72 in the partition 57 to the upstream end of the collecting channel 54*a* in the developer conveyance direction therein. The developer that has reached a downstream end portion of the collecting channel 54*a* in the developer conveyance direction by the collecting screw 54 is transported through the developer-falling opening 71 in the partition 57 as indicated by arrow e to the upstream end portion of the supply channel 53*a* in the developer conveyance direction therein.

It is to be noted that, although the supply channel 53*a* and the collecting channel 54*a* are illustrated as if they are away from each other in FIG. 7, it is intended for ease of understanding of supply and collection of developer from the developing sleeve 51. The supply channel 53*a* and the collecting channel 54*a* are separated by the planar partition 57 as shown in FIGS. 4 and 6C, and the developer-falling opening 71 and the developer-lifting opening 72 are through holes in the partition 57.

As shown in FIG. 7, developer inside the supply channel 53*a* beneath the collecting channel 54*a* is scooped onto the surface of the developing sleeve 51 while being transported in the longitudinal direction by the supply screw 53. At that time, developer can be scooped onto the surface of the developing sleeve 51 by the rotation of the supply screw 53 as well as the magnetic force exerted by the fifth pole P5, serving as a developer scooping pole. Then, the developer carried on the developing sleeve 51 is transported through the development range, separated from the developing sleeve 51, and transported to the collecting channel 54*a*. At that time, developer is separated from the surface of the developing sleeve 51 by the magnetic force exerted by a developer release pole attained by the fourth and fifth magnetic poles P4 and P5 having the same polarity (N) and being adjacent to each other and the separating capability of the partition 57.

In the developing device 5, the fourth and fifth poles P4 and P5 (i.e., the developer release pole) generate a repulsive magnetic force. In the area in which the repulsive magnetic force is generated (i.e., a developer release area), developer is released by the developer release pole in a direction of composite of a normal direction and a direction tangential to the rotation of the developing sleeve 51. Then, the developer falls under the gravity to the partition 57 and is collected by the collecting screw 54.

The collecting screw 54 in the collecting channel 54*a*, which is above the supply channel 53*a*, transports the developer separated from the developing sleeve 51 in the developer release area axially in the direction opposite the direction in which the supply screw 53 transports developer.

Through the developer-lifting opening 72, the downstream end of the supply channel 53*a* in which the supply screw 53 is provided communicates with the upstream end of the collecting channel 54*a* in which the collecting screw 54 is provided. The developer at the downstream end of the supply channel 53*a* accumulates there and pushed up by the developer transported from behind. Then, the developer moves through the developer-lifting opening 72 to the upstream end of the collecting channel 54*a*.

The toner supply inlet 59 is in the upstream end portion of the collecting channel 54*a*, and fresh toner is supplied as required by a toner supply device from the toner container 11 (shown in FIG. 2) to the developing device 5 through the toner supply inlet 59. The upstream end of the supply channel 53*a* communicates with the downstream end of the collecting channel 54*a* via the developer-falling opening 71. The developer transported to the downstream end of the collecting channel 54*a* falls under its own weight through the developer-falling opening 71 to the upstream end portion of the supply channel 53*a*.

As described above, the supply screw 53 and the collecting screw 54 rotate in the directions indicated by arrows Y1 and Y3 shown in FIG. 4, and developer is attracted to the developing sleeve 51 by the magnetic attraction exerted by the magnet roller 55 contained in the developing sleeve 51. Additionally, the developing sleeve 51 is rotated at a predetermined velocity ratio to the velocity of the photoconductor 1 to scoop developer to the development range consecutively.

In the developing device 5, while the supply screw 53 stirs and transports developer in the supply channel 53*a*, the developer is supplied onto the developing sleeve 51, and the developer on the developing sleeve 51 is collected in the collecting screw 54. Accordingly, the amount of developer transported in the supply channel 53*a* decreases toward downstream in the developer conveyance direction by the supply screw 53, and the surface of developer accumulating inside the supply channel 53*a* is oblique as shown in FIG. 7.

Assuming that Wm represents a developer conveyance capability of the supply screw 53, which can be obtained from the diameter and the pitch of the blade of the supply screw 53 and the number of rotation of the supply screw 53, and Ws represents a developer conveyance capability on the developing sleeve 51, developer can be uniformly transported on the surface of the developing sleeve 51 when Wm>Ws. If this relation is not satisfied, it is possible that the amount of developer becomes insufficient on the downstream side of the supply channel 53*a* in the conveyance direction of the supply screw 53, and developer is not supplied to the developing sleeve 51 on the downstream side. Accordingly, the supply screw 53 is to have a developer conveyance capability (Wm) greater than the amount of developer transported on the developing sleeve 51.

Additionally, when developer is collected from the developing sleeve 51 into the collecting channel 54*a*, if the bulk of the developer in the collecting channel 54*a* is excessively large and the level is high, it is possible that developer is not collected in the collecting channel 54*a* but moves through a clearance between the partition 57 and the developing sleeve 51 to the supply channel 53*a*. Then, the developer can be supplied to the developing sleeve 51 before stirred sufficiently by the supply screw 53. When the insufficiently stirred developer reaches the development range, it causes substandard images. Accordingly, the collecting screw 54 is to have a developer conveyance capability greater than the amount of developer transported on the developing sleeve 51 as well.

Thus, it is preferred that the developer conveyance capabilities of the supply screw 53 and the collecting screw 54 be greater than the amount of developer transported on the developing sleeve 51. To achieve this, the rotation speed of the supply screw 53 and the collecting screw 54 tend to be relatively high.

The developing bias applied to the developing sleeve 51 is described in further detail below.

FIG. 1 is a schematic diagram of a waveform of a developing bias Vb applied to the developing sleeve 51 by the power source 151.

In FIG. 1, reference character "GND" represents earth (ground) voltage, which is 0 V, the voltage value on the upward side in FIG. 1 is greater in the negative direction (minus side), and the voltage value on the lower side is greater in the positive direction (plus side). In FIG. 1, reference character "T" represents a single cycle of the developing bias Vb in which the voltage changes due to the AC component, "T1" represents the duration of application of positive polarity component during a single cycle of the developing bias Vb, and "T2" represents the duration of application of negative polarity component during a single cycle of the developing bias Vb.

The developing bias Vb according to the present embodiment is voltage including an AC component not greater than about 2.0 kHz in frequency (1/T). In the present embodiment, a normal charge polarity of toner is negative, and, in the developing bias Vb, the component in the polarity (positive polarity in the present embodiment) opposite the normal charge polarity of toner has a duty ratio (T1/T×100, hereinafter "positive-side duty ratio") of about 20% or smaller. Further, the difference between a largest value and a smallest value on the negative side of the developing bias Vb is about 1500 V or smaller. The smallest value on the negative side used here means a value closest to zero V in a case where the surface potential of the developing sleeve 51 fluctuates only on the negative polarity side and a greatest value on the positive polarity side in a case where the surface potential fluctuates in a range extending to the positive side.

The term "positive-side duty ratio" used here means the ratio of application time of a positive polarity component, which is on the positive side of an exposure potential VL, in one cycle of the AC bias. The positive-side duty ratio is obtained by dividing, with one cycle time (T) of the AC bias, the time (T1) during which the positive-side voltage is applied in one cycle time (T1/T). It is to be noted that, while the voltage on the positive side of the exposure potential VL is applied, an electrical field that draws back toner adhering to the electrostatic latent image on the photoconductor 1 to the developing sleeve 51 occurs.

The term "frequency" used here indicates the number of waveform cycles in one second and expressed as "1/T" when T represents one cycle time.

The example waveform shown in FIG. 1 has a frequency of 1 kHz and a positive-side duty ratio of 7%; and a peak-to-peak voltage Vpp, which means the difference between the largest value and the smallest value of the developing bias Vb, is 1000 V.

In FIG. 1, reference character Vbav represents an average of the developing bias Vb (hereinafter "developing bias average Vbav"), which is −500 V, for example, and Vd represents the charge potential, which is greater by ΔV3 than the developing bias average Vbav in the negative direction. The charge potential Vd is −100 V, for example. An upper limit on the negative side (upper limit in FIG. 1) of the developing bias Vb is greater by ΔV1 than the charge potential Vd in the negative direction in FIG. 1. The upper limit on the negative side of the developing bias Vb is greater by ΔV2 than the developing bias average Vbav in the negative direction in FIG. 1, and the relation ΔV2=Δ1+ΔV3 is established.

A lower limit on the negative side (i.e., a largest value on the positive side and the lower limit in FIG. 1) of the developing bias Vb is greater by ΔV4 than the exposure potential VL in the positive direction in FIG. 1. The lower limit on the negative side (i.e., the largest on the positive side) of the developing bias Vb is greater by ΔV5 than the developing bias average Vbav in the positive direction in FIG. 1.

In FIG. 1, reference character Vpot represents the difference between the developing bias average Vbav and the exposure potential VL (hereinafter "developing potential Vpot"), which is 400 V, for example.

Figure 8:
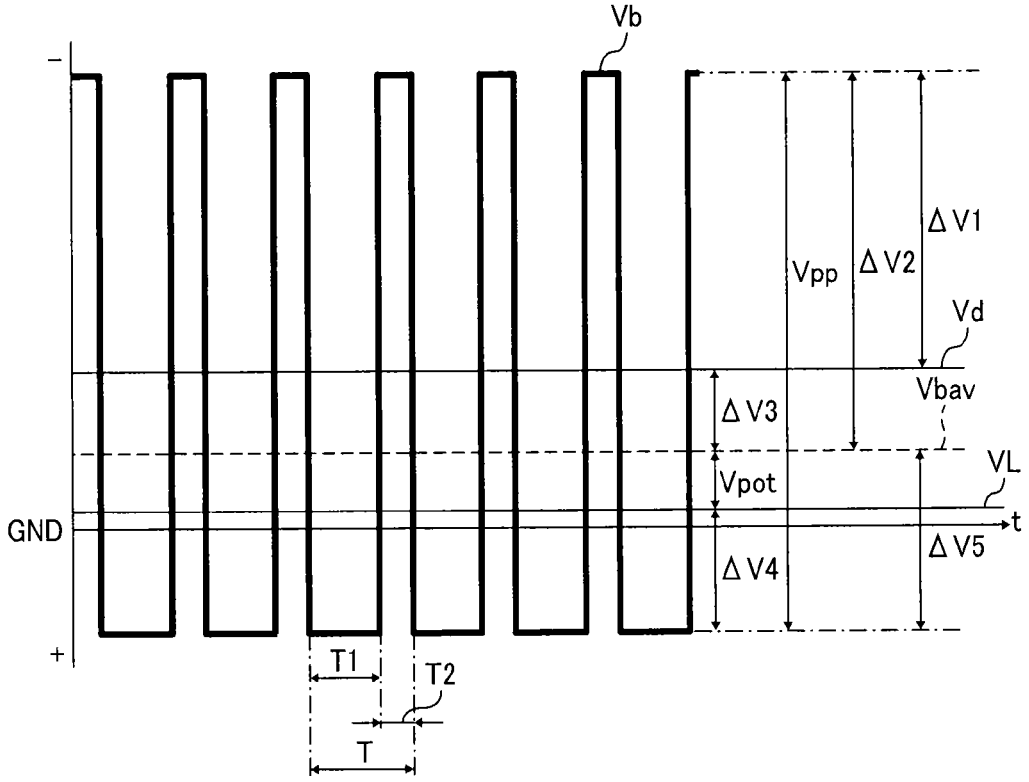
FIG. 8 RELATED ART
FIG. 8 is a diagram of a waveform of a developing bias Vb in AC bias development according to a comparative example.

FIG. 8 is a diagram of a waveform of the developing bias Vb in AC bias development according to a comparative example.

The comparative waveform shown in FIG. 8 has a frequency of 9 kHz and a positive-side duty ratio (T1/T×100) of 70%; and the peak-to-peak voltage Vpp, which means the difference between the largest value and the smallest value of the developing bias Vb, is 1500 V. In the comparative waveform in FIG. 8, for example, the developing bias average Vbav is −300 V, the exposure potential VL is −100 V, and the developing potential Vpot is 200 V.

Compared with the comparative waveform shown in FIG. 8, in the waveform of the developing bias according to the present embodiment, the duration of application of the voltage on the positive side of the exposure potential VL is shorter and the duration of application of the voltage on the negative side is longer. Specifically, in typical AC bias development in which the normal charge polarity of toner is positive, the positive-side duty ratio is 30% or greater (70% in FIG. 8). By contrast, in the waveform according to the present embodiment (shown in FIG. 1), the positive-side duty ratio (T1/T×100) is 20% or smaller and, in particular, 7% in one embodiment.

Additionally, in typical AC bias development, a high frequency of 5 kHz or greater is a mainstream, and the frequency is 9 kHz in the comparative waveform shown in FIG. 8. By contrast, the waveform according to the present embodiment has a frequency of 2 kHz or smaller, and, in particular, 990 Hz in one embodiment.

Thus, compared with the waveform in typical AC bias development, the waveform of the developing bias according to the present embodiment has a low frequency and the duty ratio of component opposite the normal charge polarity of toner is low.

Hereinafter the AC developing bias having the above-described features according to the present embodiment is referred to as "RP developing bias", and the type of image development employing the RP developing bias is referred to as "RP development" for convenience. The inventors of the present application has experimentally confirmed that, in image formation employing the RP development, cyclic density unevenness due to the rotation cycle of the developing sleeve 51 is suppressed, and simultaneously the occurrence of void at density boundaries (absence of toner at the boundary between portions different in image density) and degradation of graininess are suppressed. In experimental image formation in which conditions of the developing bias applied to the developing sleeve 51 were varied, graininess was alleviated to a level similar to that achieved in the DC bias development, compared with typical AC bias development.

In the RP development using the waveform, for example, shown in FIG. 1 and the typical AC bias development using the waveform, for example, shown in FIG. 8, the developing bias average Vbav is equivalent to the developing bias Vb in the DC bias development. Accordingly, when the surface potential of the photoconductor 1 is on the positive side of the developing bias average Vbav (beneath the developing bias average Vbav in FIGS. 1 and 8), toner moves from the developing sleeve 51 to the photoconductor 1, thereby developing the latent image thereon. By contrast, toner does not move from the developing sleeve 51 to the photoconductor 1 and development is not made when the surface potential of the photoconductor 1 is on the negative side of the developing bias average Vbav (above the developing bias average Vbav in the waveforms shown in FIGS. 1 and 8).

Accordingly, the electrostatic latent image on the photoconductor 1 is developed when, in the negative polarity, the developing bias average Vbav is smaller than the charge potential Vd and greater than the exposure potential VL (Vd>Vbav>VL).

It is to be noted that, in the present embodiment, the exposure potential VL is in the range of 0 V±100 V similar to typical image forming apparatuses. For example, the exposure potential VL is −100 V in FIGS. 1 and 8.

In the RP development, lowering the frequency is effective in suppressing the occurrence of void at density boundaries, which tends to occur in the AC bias development in which the frequency is higher. Additionally, in the RP development, lowering the positive-side duty ratio is effective in alleviating graininess, which tends to occur in the AC bias development in which the frequency is lower and the positive-side duty ratio is higher.

Next, the potential of the developing sleeve 51 and that of the photoconductor 1 are described below.

In typical electrophotographic image forming apparatuses, the surface of the photoconductor 1 is uniformly charged and then exposed by the exposure device, thereby forming an electrostatic latent image. Then, the electrostatic latent image is developed into a toner image. At that time, by applying, to the developing sleeve 51, a potential greater on the normal charge polarity of toner (on the negative side in the present embodiment) than that of the electrostatic latent image, and the potential difference is to transfer toner from the developing sleeve 51 to the electrostatic latent image is secured.

In the case of DC bias application, the surface potential of the developing sleeve 51 is constant since the voltage applied to the developing sleeve 51 is constant. Accordingly, a potential difference that transfers toner from the developing sleeve 51 to the exposed portion on the photoconductor 1 occurs but a potential difference that draws back toner in the opposite direction does not occur.

By contrast, in the case of AC bias application, in a very short period, the potential difference that transfers toner from the developing sleeve 51 to the photoconductor 1 alternates with the potential difference that draws back toner therefrom to the developing sleeve 51 relative to the electrostatic latent image. Even when the potential difference that draws back toner from the photoconductor 1 to the developing sleeve 51 is generated, toner can move to the electrostatic latent image because the potential difference to transfer toner to the photoconductor 1 is secured between an average potential of the AC bias and the potential of the electrostatic latent image.

Application of an AC bias is advantageous over application of DC bias in alleviating image density unevenness. A conceivable cause of this is that the amount of toner adhering to the photoconductor 1 is equalized, thereby reducing differences in color shading, by drawing back toner from the photoconductor 1 to the developing sleeve 51 and again transferring toner to the photoconductor 1. The effective to alleviate image density unevenness is greater when the AC bias frequency is increased, or the peak-to-peak value (difference between the largest value and the smallest value of the developing bias) is increased.

The inventors further recognize the followings.

Increases in the frequency strengthens the action to draw back toner and accordingly increases the possibility of occurrence of void at density boundaries, meaning the image failure in which toner is absent at a boundary between portions different in image density. To alleviate the void at density boundaries, the frequency of AC bias is set to 2 kHz or smaller in the present embodiment.

Additionally, increases in the peak-to-peak value increases the movement of toner and accordingly further inhibit image density unevenness. However, the occurrence of background stains, meaning that adhesion of toner to non-image areas on the photoconductor 1, increases. Therefore, the peak-to-peak value is 1500 V or lower in the present embodiment.

Under these conditions, it is possible that the action of AC bias to draw back toner worsens the image graininess, that is, image uniformity is degraded. Therefore, to alleviate the degradation in graininess, the positive-side duty ratio (T1/T×100 in FIG. 1), meaning the ratio of application time of voltage in the polarity opposite the normal charge polarity of toner relative to one cycle time of AC bias, is 20% or smaller in the present embodiment.

Descriptions are given below of experiments in researching desirable setting of the peak-to-peak value, and the frequency and the positive-side duty ratio of the AC bias.

[Experiment 1]

Experiment 1 is executed to confirm an upper limit of the peak-to-peak value (Vpp) based on the relation with background stains. Background stains were evaluated by visually observing the adhesion (i.e., scattering) of toner on non-image areas when a given image was output.

Conditions of experiment 1 are as follows.

Image forming apparatus: Ricoh imagio MP C5000;

Developer: Cyan;

Developing sleeve: Aluminum sleeve coated with tetrahedral amorphous carbon (hereinafter "ta-C coating); and Developing bias: DC bias only and DC bias superimposed with AC component (frequency: 990 Hz and positive-side duty ratio: 7%

Inhibition of background stains is rated according to the following criteria:

5: Background stains not observed;

4: No problem;

3: Acceptable;

2: Not acceptable; and

1: Bad (worse than 2).

In experiment 1, background stains under different developing bias conditions were evaluated according to the criteria described above, and FIG. 9 shows evaluation results thereof As the different developing bias conditions, images were formed under DC bias application and AC bias application, and the peak-to-peak value Vpp was set to 1.25 kV, 1.5 kV, and 1.75 kV in AC bias application.

Figure 9:
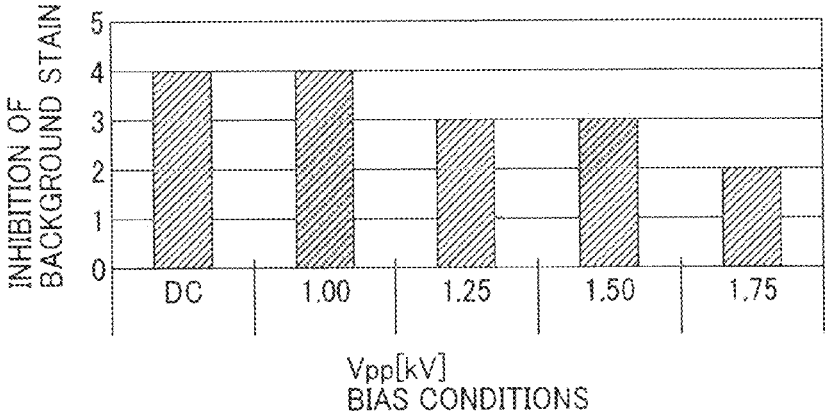
FIG. 9 is a graph illustrating results of experiment 1.

As shown in FIG. 9, background stains did not occur in DC bias application, but background stains were rated "4: Not acceptable" in application of AC bias having the peak-to-peak value Vpp of 1.75 kV. Therefore, when the AC bias is used, the peak-to-peak value Vpp is 1.5 kV or lower in the present embodiment.

[Experiment 2]

Experiment 2 was executed to confirm an upper limit of the frequency of the developing bias based on the relation between the frequency of the developing bias and the void at density boundaries. Images patterned with check of solid areas and half density areas were visually checked for void at density boundaries.

Conditions of experiment 2 are as follows.

Image forming apparatus: Ricoh imagio MP C5000;

Developer: Cyan;

Developing sleeve: Aluminum sleeve coated with ta-C coating; and

Developing bias: DC bias only and DC bias superimposed with AC component (peak-to-peak value: 800 V and positive-side duty ratio: 7%)

Inhibition of void at density boundaries was rated according to the following criteria:

5: Void at density boundaries not observed;

4: No problem;

3: Acceptable;

2: Not acceptable; and

1: Bad (worse than 2).

Results of experiment 1 under different developing bias conditions, evaluated according to the criteria described above, are in FIG. 10.

As the different developing bias conditions, images were formed under DC bias application and AC bias application, and the peak-to-peak value frequency was set to 0.99 kHz, 2 kHz, 5.5 kHz, and 9 kHz in AC bias application.

Figure 10:
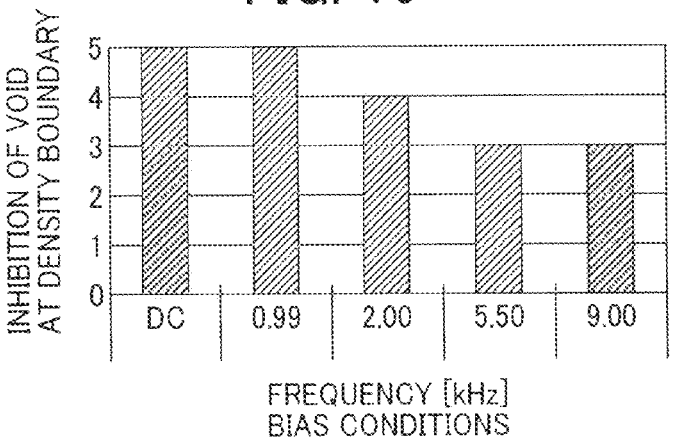
FIG. 10 is a graph illustrating results of experiment 2.

As shown in FIG. 10, the void at density boundaries did not occur in DC bias application. In AC bias application with the frequency range examined, inhibition of void at density boundaries is "3: Acceptable" or better. In particular, the rating is improved to "4" with the frequency of 2 kHz in contrast to the rating "3" obtained with the frequency of 5.5 kHz. Therefore, when the AC bias is used, the frequency is 2 kHz or lower in the present embodiment.

Further, in FIG. 10, in the case of the frequency of 0.99 kHz, the void at density boundaries is rated "5: Not observed" and thus improved from the rating obtained with the frequency of 2 kHz. Therefore, when the AC bias is used, to inhibit the void at density boundaries, the frequency is 2 kHz or lower in one embodiment and 1 kHz or lower in another embodiment.

When the frequency is extremely low, however, image density unevenness resulting from the cycle of AC bias is degraded to be visually recognizable. Specifically, stripes due to image density differences in the direction in which the sheet P is transported appears.

When the frequency was shifted lower from 990 Hz, image density unevenness was not recognizable with eyes in the range from 990 Hz to 800 Hz. When the frequency was 700 Hz, however, stripes become recognizable with eyes, and the stripes were clear when the frequency was 600 Hz. Therefore, in the present embodiment, the frequency is 800 Hz or greater.

[Experiment 3]

Experiment 3 was executed to confirm an upper limit of the positive-side duty ratio of the developing bias based on the relation between the positive-side duty ratio of the developing bias and image graininess. For image graininess evaluation, images having an image area ratio of 70% were visually checked.

Conditions of experiment 3 are as follows.

Image forming apparatus: Ricoh imagio MP C5000;

Developer: Cyan;

Developing sleeve: Aluminum sleeve with ta-C coating; and

Developing bias: DC bias only and DC bias superimposed with AC component (peak-to-peak value: 800 V and frequency: 990 Hz)

Image graininess is rated according to the following criteria:

5: Graininess preferable;

4: No problem;

3: Acceptable;

2: Not acceptable; and

1: Bad (worse than 2).

Results of experiment 3 under different developing bias conditions, evaluated according to the criteria described above, are in FIG. 11.

As the different developing bias conditions, images were formed under DC bias application and AC bias application, and the positive-side duty ratio was set to 4%, 7%, 20%, and 50% in AC bias application.

Figure 11:
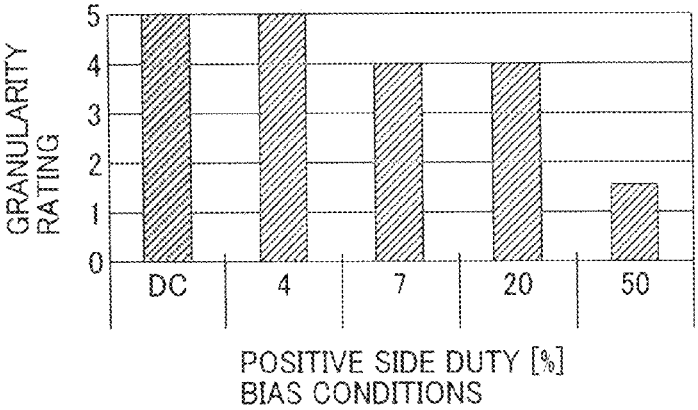
FIG. 11 is a graph illustrating results of experiment 3.

According to FIG. 11, the image graininess in DC bias application is desirable level. By contrast, the image graininess in AC bias application is poorer than "2: Not acceptable", making the image rougher, when the positive-side duty ratio is 50%. In AC bias application with the positive-side duty ratio of 20%, the image graininess is rated "4: No problem" and better than "3: Acceptable".

As shown in FIG. 10, it is advantageous that the frequency of the Ac bias is 2 kHz or smaller in inhibiting void at density boundaries. However, in FIG. 11, in application of AC bias having a frequency of 1 kHz, which is lower than 2 kHz, when the positive-side duty ratio is 50%, the image graininess rating is poorer than that in application of DC bias. Therefore, to alleviate the degradation of graininess, the positive-side duty ratio is lowered (to 20% or smaller), thereby weakening the action to draw back toner to the developing sleeve 51 from the electrostatic latent image on the photoconductor 1. Therefore, in one embodiment, when the frequency is 2 kHz or smaller in AC bias application, the positive-side duty ratio is 20%.

The positive-side duty ratio of 7% is more advantageous than 20% in further alleviating image graininess.

Figure 12:
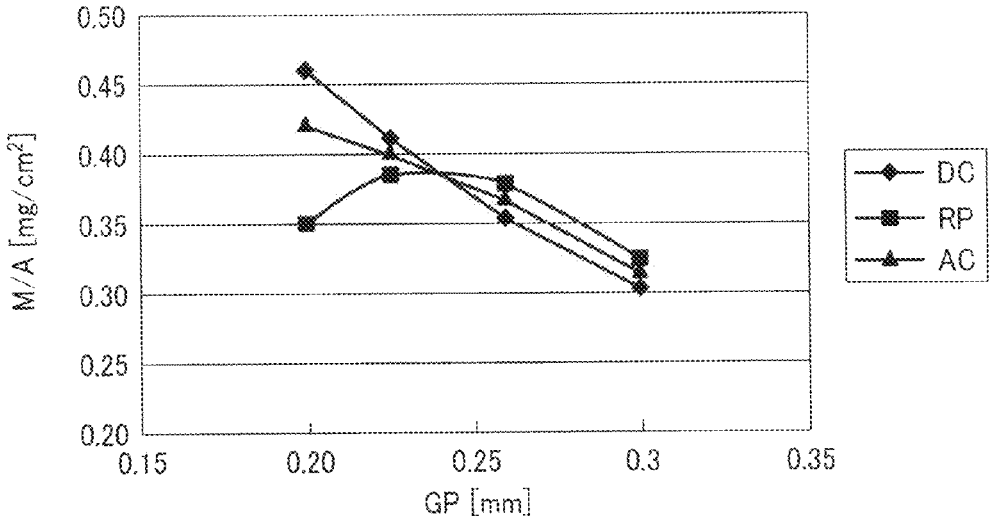
FIG. 12 is a graph of fluctuations in toner adhesion amount relative to fluctuations in a development gap.

FIG. 12 is a graph of fluctuations in the amount of toner borne on an unit area, which is hereinafter referred to as "toner adhesion amount", relative to fluctuations in a development gap GP in DC bias development ("DC" in FIG. 12), typical AC bias development ("AC" in FIG. 12), and the RP development ("RP" in FIG. 12). The toner adhesion amount is represented by "M/A (mg/cm$^2$)" in the drawings.

As shown in FIG. 12, when the development gap GP is equal to or greater than 0.25 mm, in any of the development gap conditions compared, the toner adhesion amount decreases as the development gap GP increases. By contrast, when the development gap GP is smaller than 0.25 mm, in the DC bias development, the toner adhesion amount increases as the development gap GP is reduced. By contrast, in typical AC bias development, even if the development gap GP is reduced further, the increase in toner adhesion amount stops at 0.4 mg/cm$^2$. Additionally, in the RP development, although the toner adhesion amount increases until the development gap GP decreases to a certain size, the toner adhesion amount at the development gap GP of 0.2 mm is smaller than that at the greater development gap GP.

As shown in FIG. 12, a disadvantage in the DC bias development is that the toner adhesion amount fluctuates in a wider range as the development gap GP fluctuates in size. Accordingly, if the developing sleeve 51 is eccentric due to tolerance in production or the like, the development gap GP fluctuates in accordance with the rotation cycle of the developing sleeve 51, and the image density is more likely to be uneven corresponding to the rotation cycle in the DC bias development. By contrast, in typical AC bias development or the RP development according to the present embodiment, the fluctuation range of toner adhesion amount due to fluctuations in the development gap GP is narrower than that in the DC bias development. Accordingly, the occurrence of image density unevenness due to the rotation cycle of the developing sleeve 51 is inhibited. Additionally, causes of fluctuations in the development gap GP are not limited to the rotation cycle of the developing sleeve 51. In the RP development, however, the image density unevenness due to fluctuations in the development gap GP is inhibited since the fluctuation range of toner adhesion amount due to fluctuations in the development gap GP is narrower.

Figure 13:
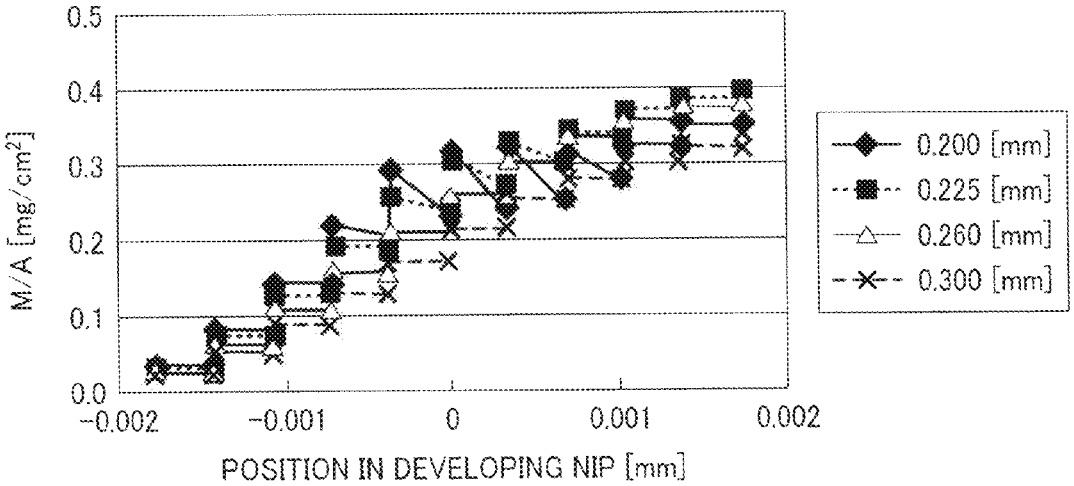
FIG. 13 is a graph illustrating changes in toner adhesion amount depending on a position in a developing nip when the development gap is varied.

FIG. 13 is a graph of simulated fluctuations in toner adhesion amount in the developing nip in the RP development. The position in the development nip is regarded zero (0) when the developing sleeve 51 is closest to the photoconductor 1, and the positions −0.001 mm and −0.002 mm are upstream from the closest position in the direction of rotation of the photoconductor 1. The positions 0.001 mm and 0.002 are downstream from the closest position in the direction of rotation of the photoconductor 1. Additionally, the values corresponding to graphs of 0.2 mm, 0.225 mm, 0.26 mm, and 0.3 mm indicate the values of the development gap GP at the closest position.

According to the graph in FIG. 13, it is known how toner adheres and moves away at positions upstream and downstream from the closest position of the developing nip when the development gap GP is varied. According to FIG. 13, in the RP development, toner alternately adheres to and moves away from the photoconductor 1 in the developing nip, and the toner adhesion amount saturates on the downstream side in the direction of rotation of the photoconductor 1.

As shown in FIG. 1, in the RP development, there are periods in which the voltage applied to the developing sleeve 51 falls on the positive side of the exposure potential VL. At that time, toner is drawn back from the electrostatic latent image on the photoconductor 1 to the developing sleeve 51, and thus the toner adhesion amount is decreases temporarily. The toner, however, adheres again to the electrostatic latent image on the photoconductor 1 upon application of voltage on the negative side of the exposure potential VL after the voltage on the positive side of the exposure potential VL is applied. Additionally, since the developing bias average Vbav is on the negative side of the exposure potential VL, as shown in FIG. 13, while toner alternately adheres to and moves away from the electrostatic latent image, the toner adhesion amount increases in the direction of rotation of the photoconductor 1. Thus, the toner adhesion amount to develop the electrostatic latent image is secured.

Figure 14:
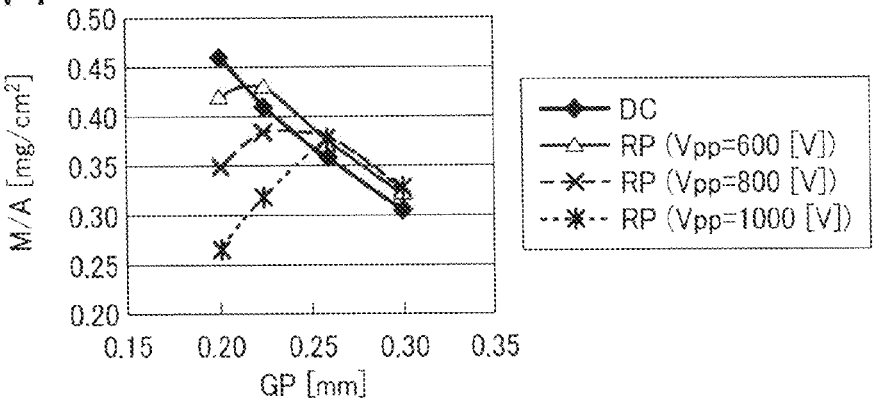
FIG. 14 is a graph illustrating the relation of toner adhesion amount and the development gap when a peak-to-peak value is varied.

FIG. 14 is a graph illustrating the relation of toner adhesion amount and the development gap GP in the DC bias development and in the RP development in which the peak-to-peak value Vpp is varied. In an experiment that produced the results in FIG. 14, the developing bias in the RP development had a positive-side duty ratio of 4% and a frequency of 990 Hz.

According to FIG. 14, under the developing bias conditions in which the positive-side duty ratio is 4% and the frequency is 990 Hz, in the range examined, fluctuations in toner adhesion amount relative to the development gap GP are small when the peak-to-peak value Vpp is 800 V. As the fluctuation range of toner adhesion amount relative to the development gap GP becomes smaller, the possibility of occurrence of image density unevenness corresponding to the rotation cycle of the developing sleeve 51 decreases. Therefore, under the conditions in which the positive-side duty ratio is 4% and the frequency is 990 Hz, setting the peak-to-peak value Vpp at 800 V is advantageous in inhibiting the image density unevenness.

Figure 15:
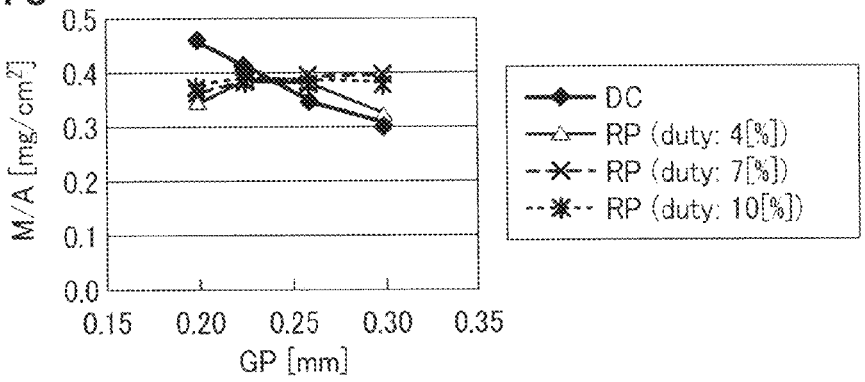
FIG. 15 is a graph illustrating the relation of toner adhesion amount and the development gap in DC bias development and RP development.

FIG. 15 is a graph illustrating the relation of toner adhesion amount and the development gap GP in the DC bias development and the RP development in which the positive-side duty ratio is varied. In an experiment that produced the results in FIG. 15, the developing bias in the RP development had a peak-to-peak value Vpp of 800 V and a frequency of 990 Hz. The positive-side duty ratio was set to 4%, 7%, and 10%. According to FIG. 15, with any of the above-described positive-side duty ratios, the fluctuation range of toner adhesion amount relative to fluctuations in the development gap GP is smaller in the RP development than the DC bias development.

The RP development having waveform shown in FIG. 1 is advantageous in inhibiting the void at density boundaries compared with AC bias development having the comparative waveform shown in FIG. 8.

Specifically, at the edges of images, electrical potentials increase from the exposure potential VL due to edge effects. In the waveform shown in FIG. 8, the developing potential Vpot is smaller than that in the waveform shown in FIG. 1, and development becomes difficult with slight fluctuations in potential difference. Thus, it is conceivable that the waveform shown in FIG. 8 is affected more by the edge effects than that shown in FIG. 1.

For example, it is assumed that the edge effects cause the potential of an image area to increase by 20 V from the exposure potential VL. In this case, the developing potential Vpot is 200 V in the AC bias development having the waveform shown in FIG. 8, and the decrease by 20 V in potential difference means 10% reduction in potential difference between the surface of the developing sleeve 51 and the electrostatic latent image. Accordingly, images tends to become lighter in density.

By contrast, in the RP development having the waveform shown in FIG. 1, the developing potential Vpot is 400 V and greater than that in the waveform shown in FIG. 8. Therefore, in the RP development having the waveform shown in FIG. 1, even when the potential difference is reduced by 20 V due to the edge effects, the reduction in the potential difference between the developing sleeve 51 and the electrostatic latent image is smaller than that in the waveform shown in FIG. 8. Accordingly, it is conceivable that the degree of decreases in image density is smaller, and the effects of void at density boundaries are smaller.

Figure 16:
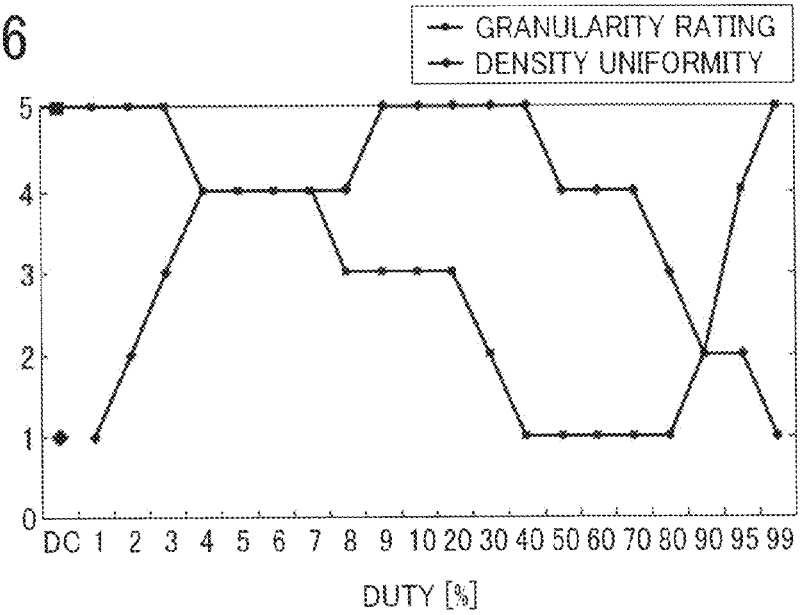
FIG. 16 is a graph of results of an experiment to confirm image graininess and image density unevenness in relation to changes in a positive-side duty ratio.

FIG. 16 is a graph of results of the experiment in which image graininess and image density unevenness were evaluated while the positive-side duty ratio of the AC bias was varied. In the experiment, the peak-to-peak value Vpp was fixed at 1 kV and the frequency was fixed at 990 Hz. In FIG. 16, a square plotted at the left end represents the evaluation of image graininess in the DC bias development and a diamond plotted at the left end represents the evaluation of density unevenness in the DC bias development.

In conventional AC bias development, image graininess is degraded when the positive-side duty ratio is in a range from 50% to 70% and the frequency is set to 1 kHz or smaller to inhibit the occurrence of void at density boundaries. Therefore, in the experiment, the range of positive-side duty ratio was widened to find a range to keep both of graininess and image density unevenness at "Acceptable" levels or better.

The ratings of image graininess in FIG. 16 are based on the criteria used in experiment 3 described above, and the ratings of image density unevenness are based on the following criteria:

5: Image density unevenness not observed;
4: No problem;
3: Acceptable;
2: Not acceptable; and
1: Bad (worse than 2).

In FIG. 16, in the DC bias development, image density unevenness is rated poorer than "3: Acceptable". In the AC bias development with a range of positive-side duty ratio from 30% to 80%, image graininess is rated poorer than "3: Acceptable". By contrast, in the AC bias development with a range of positive-side duty ratio from 4% to 10%, both of image density unevenness and image graininess are rated "3: Acceptable" or better. Thus, the improvement of graininess and inhibition of image density unevenness are balanced. It is to be noted that, when the positive-side duty ratio is lower than 4%, the rating of image density unevenness is poorer than "3: Acceptable". Therefore, to inhibit image density unevenness, the positive-side duty ratio is set to 4% or greater.

Additionally, an experiment was performed to research the behavior of toner on the surface of the photoconductor 1 passing through the developing nip in both cases where the developing bias had the waveform shown in FIG. 1 and the comparative waveform shown in FIG. 8.

Specifically, in the experiment, a transparent glass drum was used instead of the photoconductor 1, the developing nip was shot consecutively from inside the glass drum, and the behavior of toner was checked on the images of the developing nip.

When the developing bias having the waveform shown in FIG. 8 was applied to the developing sleeve 51, the toner once adhered to the photoconductor 1 vibrated on the photoconductor 1 and rarely moved back to the developing sleeve 51. By contrast, when the developing bias having the waveform shown in FIG. 1 was applied to the developing sleeve 51, most of the toner once adhered to the photoconductor 1 cyclically moved back thereto and again adhered to the photoconductor 1.

The followings are assumed factors that have caused the above-described difference in behavior.

In the AC bias development, image are developed due to the difference between the developing bias average Vbav and the exposure potential VL. Additionally, even when the largest value on the positive side of the developing bias Vb is identical, the developing bias average Vbav is shifted to the positive direction as the positive-side duty ratio increases.

In the comparative waveform shown in FIG. 8, the positive-side duty ratio is 70% and thus relatively large. Accordingly, if the largest value on the positive side of the developing bias Vb is increased, unfortunately the developing bias average Vbav falls on the positive side of the exposure potential VL, or, even if the developing bias average Vbav remains on the negative side, the potential difference with the exposure potential VL becomes insufficient. Therefore, the waveform shown in FIG. 8 is designed so that the largest value on the positive side is smaller and the potential difference (ΔV4 in FIG. 8) to draw back toner from the photoconductor 1 to the developing sleeve 51 is smaller (for example, 250 V).

Since the potential difference is smaller and the force to draw back toner from the photoconductor 1 to the developing sleeve 51 is weaker, toner on the photoconductor 1 does not return to the developing sleeve 51 but just vibrates on the photoconductor 1.

By contrast, in the waveform shown in FIG. 1, the positive-side duty ratio is 7% and thus relatively small. Accordingly, even if the largest value on the positive side of the developing bias Vb is increased, a sufficient potential difference for toner to move to the photoconductor 1 is secured between the developing bias average Vbav and the exposure potential VL. Therefore, in the waveform shown in FIG. 1, the largest value on the positive side is set to a larger value and the potential difference (ΔV4 in FIG. 1) to draw back toner from the photoconductor 1 to the developing sleeve 51 is larger (for example, 530 V).

Since the potential difference is larger and the force to draw back toner from the photoconductor 1 to the developing sleeve 51 is stronger, it is conceivable that most of the toner on the photoconductor 1 cyclically returns to the developing sleeve 51.

In the case of the waveform shown in FIG. 1, although toner repeatedly adheres to and moves away from the photoconductor 1, a desired amount of toner adheres to the photoconductor 1 due to the potential difference between the developing bias average Vbav and the exposure potential VL.

There are the following advantages when most of toner adhering to the photoconductor 1 is drawn back to the developing sleeve 51 as in the waveform shown in FIG. 1.

That is, when an excessive amount of toner adheres to the photoconductor 1 due to, for example, a relatively narrow development gap GP, the excessive toner on the photoconductor 1 can be partly returned to the developing sleeve 51 and thus collected. By contrast, even if the amount of toner adhering to the photoconductor 1 is excessive, in the waveform shown in FIG. 8, the toner on the photoconductor 1 does not return to the developing sleeve 51 but vibrates on the photoconductor 1. Accordingly, the amount of toner remains excessive, and the image density becomes unevenness.

The waveform shown in FIG. 1 collects the excessive toner and eventually covers insufficiency of toner on the photoconductor 1 by the potential difference between the developing bias average Vbav and the exposure potential VL. Thus, the image density can be equalized.

It is to be noted that, in the graph of RP development in FIG. 12, it is conceivable that the action to draw back toner from the photoconductor 1 to the developing sleeve 51 decreases the toner adhesion amount when the development gap GP is 0.2 mm and thus relatively narrow. Thus, an excessive increase in the toner adhesion amount is inhibited by making the development gap GP relatively narrow.

As shown in FIG. 12, in the RP development, the image density unevenness due to fluctuations in the development gap GP is inhibited since the fluctuation range of toner adhesion amount due to fluctuations in the development gap GP is narrower.

In the arrangement shown in FIGS. 3 and 4, the surface of the developing sleeve 51 and that of the photoconductor 1 move in an identical direction in the development range, in which the developing roller 50 faces the photoconductor 1.

According to a further research by the inventors, even in the above-described RP development, it is possible that the image graininess is degraded when the linear velocity ratio, meaning the ratio of the speed at which the surface of the developing sleeve 51 moves relative to the speed at which the surface of the photoconductor 1 moves, is improper.

In an experiment, the rotation speed of the developing sleeve 51 was varied under a developing bias condition of RP development in which the peak-to-peak value Vpp was 1000 V, the frequency was 990 Hz, and the positive-side duty ratio was 7%.

When the surface movement speed of the developing sleeve 51 is Vs (m/s) and the surface movement speed of the photoconductor 1 is Vg (m/s), the linear velocity ratio is expressed as Vs/Vg.

When the surface movement speed of the developing sleeve 51 was identical to the surface movement speed of the photoconductor 1 (linear velocity ratio Vs/Vg=1.0), the image graininess was degraded. When the linear velocity ratio Vs/Vg was 1.2, the image graininess was improved from that in the case where Vs/Vg was 1.0, but the improvement was not sufficient.

In a range of linear velocity ratio from 1.3 to 1.8, the image graininess was preferable level. When the linear velocity ratio was increased from 1.8, the image graininess was again degraded.

Therefore, in the present embodiment, the range of linear velocity ratio Vs/Vg is from 1.3 to 1.8.

The image forming apparatus 500 according to the present embodiment includes the multiple image forming units 6, and the respective developing devices 5 of the image forming units 6 use different color toners. In the case of image forming apparatuses including the multiple developing devices 5 similar to the image forming apparatus 500 shown in FIG. 2, the developing bias may be different among the multiple developing devices 5 depending on the type of toner used therein.

For example, the developing device 5K for black employs the DC bias development, and the other three developing devices 5 may employ the RP development described above.

Since image density unevenness is less perceivable and degradation in image uniformity (graininess) is more perceivable in black images, the DC developing bias, which is effective in inhibiting graininess, is applied to the developing sleeve 51 of the developing device 5K for black. By contrast, the RP developing bias, in which the positive-side duty ratio is smaller, is applied to the developing sleeves 51 of the developing devices 5 for the other colors (Y, M, and C). This configuration is effective in inhibiting image density unevenness while inhibiting degradation of graininess.

Descriptions are given below of causes that make image graininess in black images more recognizable.

An experiment was conducted to evaluate dot area standard deviation and graininess when the charge amount of developer was varied.

Figure 17:
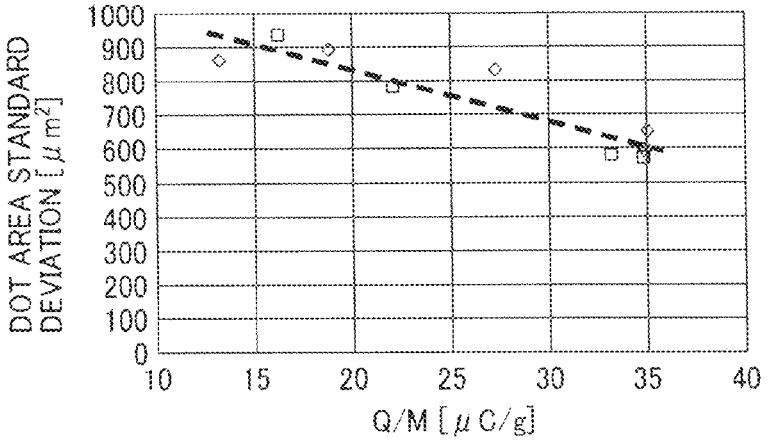
FIG. 17 is a graph of the relation between dot area standard deviation and toner charge amount.

FIG. 17 is a graph of the relation between dot area standard deviation, defined below, and toner charge amount. The dot area standard deviation is calculated as follows. Uniform dots of about 80 μm arranged at equal intervals were printed, 100 out of the printed dots were captured with a charge-coupled device (CCD) camera, and binarized areas of dots were calculated. The dot area standard deviation used in the present specification means the standard deviation of the binarized areas of dots thus obtained.

The results shown in FIG. 17 were obtained under the following experiment conditions.

Figure 18:
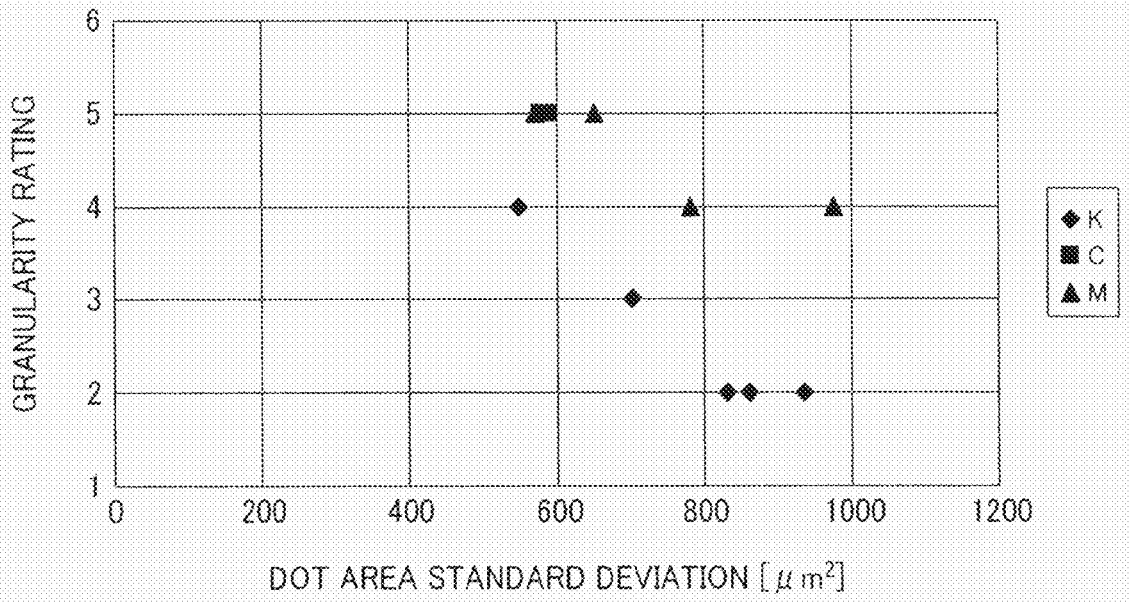
FIG. 18 is a graph of the relation between dot area standard deviation and granularity rating (degradation of uniformity)

Apparatus used: RICOH Pro C751EX;

Developing device used: Developing devices for black, cyan, and magenta;

Developing potential (difference between the developing bias and potential in image portions on the photoconductor): Adjusted to attain an image density of 1.5; and CCD camera: Micro scope VHX-100 from Keyence corporation FIG. 18 is a graph of a relation between the dot area standard deviation and granularity ratings (degradation of uniformity).

Image graininess (degradation of image uniformity) is rated according to the following criteria:

5: Graininess not recognized;

4: No problem;

3: Acceptable;

2: Not acceptable; and

1: Bad (worse than 2).

According to FIGS. 17 and 18, it is known that, as the charge amount of developer decreases, the dot area standard deviation increases, thus degrading graininess (image uniformity is degraded). By contrast, as the charge amount of developer increases, the dot area standard deviation decreases, thus alleviating graininess (image uniformity is improved). It is conceivable that the transfer properties of toner improve as the charge amount of toner on the photoconductor 1 increases, and thus variations in shape of dots are reduced.

Additionally, according to the result shown in FIG. 18, even with an identical dot area standard deviation, the image graininess differs among black (B), cyan (C), and magenta (M) when the charge amount is smaller. Specifically, although the graininess in cyan and magenta images are acceptable level, the graininess in black images is degraded.

Accordingly, in color images (such as cyan and magenta images) other than black images, the effects on graininess are smaller even when the dot area standard deviation increases to a certain degree. In black images, however, image graininess is degraded by the increase in the dot area standard deviation.

Thus, the image graininess is more recognizable in black images.

In the above-described case, black images, which are susceptible to graininess degradation, are developed in the DC development effective in inhibiting graininess, and the other color images are developed in the RP development effective in inhibiting image density unevenness. Thus, image density unevenness is inhibited while inhibiting degradation of image graininess.

Mechanism of degradation of image graininess (granularity) is described below.

As described above, in the AC bias development, the potential different to transfer toner to the photoconductor 1 is secured between the average potential of the AC bias and the potential of the electrostatic latent image on the photoconductor 1, and thus the electrostatic latent image is developed with toner. The electrostatic latent image, however, is not fully filled with toner if the potential difference that draws back toner from the photoconductor 1 to the developing sleeve 51 is large. A trace of returned toner remains in the toner image developed on the photoconductor 1, and toner is partly absent in the toner image. Such an image looks grainy (a grainy image).

To reduce the amount of toner returned from the photoconductor 1 to the developing sleeve 51, it is effective to adopt the above-described RP development in which the positive-side duty ratio of the AC developing bias is reduced.

Figure 19:
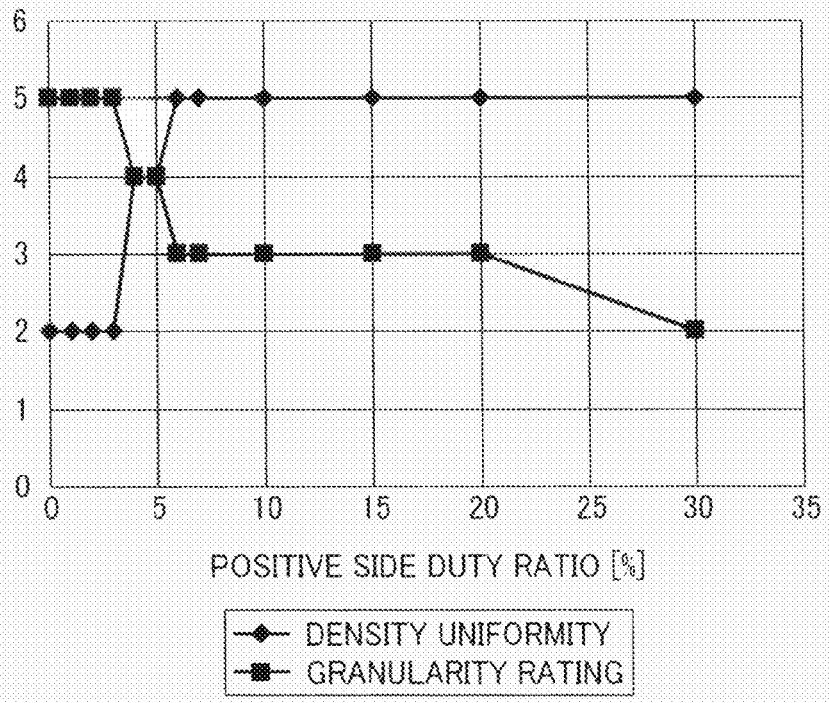
FIG. 19 is a graph of ratings of image density unevenness and graininess (image uniformity) when the positive-side duty ratio of the AC developing bias is varied in a developing device for cyan.
Figure 20:
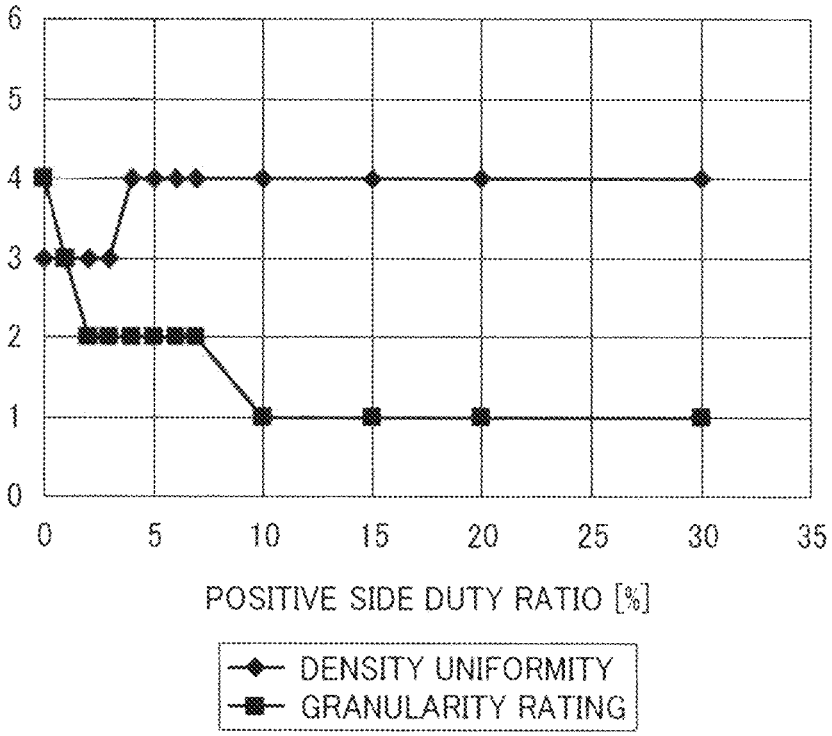
FIG. 20 is a graph of ratings of image density unevenness and graininess (image uniformity) when the positive-side duty ratio of the AC developing bias is varied in a developing device for black.

FIG. 19 is a graph of ratings of image density unevenness and graininess (image uniformity) when the positive-side duty ratio of the AC developing bias was varied in the developing device 5C for cyan. FIG. 20 is a graph of image density uniformity rating (density unevenness) and granularity rating (graininess) when the positive-side duty ratio of the AC developing bias was varied in the developing device 5K for black. The ratings in FIGS. 19 and 20 were obtained with the positive-side duty ratio varied within a range from 1% to 30%. The positive-side duty ratio is "0%" in FIGS. 19 and 20 when the DC developing bias is applied to the developing sleeve 51. An image having an image area ratio of 75% was used for image density unevenness ratings, and an image having an image area ratio of 30% was used for graininess ratings.

The results shown in FIGS. 19 and 20 were obtained under the following experiment conditions.

Image forming apparatus: Modification of Ricoh imagio MP C5000;

Developer: Cyan and Black;

Developing sleeve: Aluminum sleeve coated with ta-C (0.6 μm with deviation of 0.3 μm); and Developing bias: DC component and AC component superimposed thereon; Frequency of AC component: 1 kHz;

Amplitude of AC component (peak-to-peak): 800 V;

Duty ratio of positive side of AC component: 1% to 30%; and

DC component: Adjusted to attain an image density of 1.5

Ratings of graininess (on image area ratio of 30%) and image density unevenness (on image area ratio of 75%) are as follows.

5: Not observed;

4: No problem;

3: Acceptable;

2: Not acceptable; and

1: Bad

According to FIG. 19, in the developing device 5C for cyan, inhibition of image density unevenness and that of graininess are balanced ("3: Acceptable" or better).

According to FIG. 20, in the developing device 5K for black, inhibition of image density unevenness and that of graininess are balanced ("3: Acceptable" or better) when the DC developing bias is applied (positive-side duty ratio is 0%).

Therefore, inhibition of image density unevenness and that of graininess are balanced in all of the developing devices 5 by employing the DC development in the developing device 5K for black and employing the RP development in the developing devices 5 for other colors.

Next, the developing roller 50 is described in further detail below.

Figure 21:
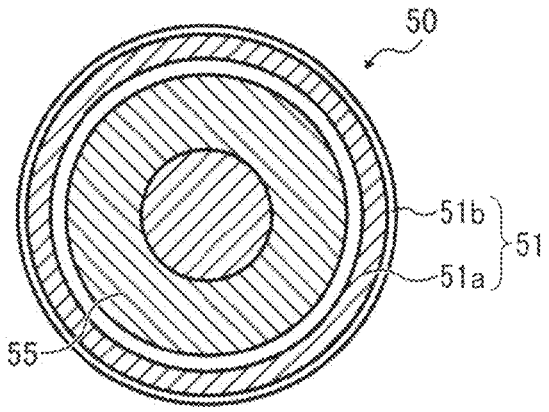
FIG. 21 is a an end-on axial view of a developing roller according to an embodiment.

FIG. 21 is an enlarged cross-sectional view of the developing roller 50 of the developing device 5.

As shown in FIG. 21, in the present embodiment, the developing sleeve 51 of the developing roller 50 includes a base pipe 51*a* made of a base material that secures a cylindrical shape and a low friction film 51*b*. For example, the base pipe 51*a* includes or is made of aluminum. The low friction film 51*b* is a surface layer and lower in friction coefficient with toner (i.e., a low friction surface layer) than the base pipe 51*a*.

Additionally, in the configuration shown in FIG. 4, the power source 151, serving as a developing sleeve voltage application member, is connected to the base pipe 51*a* of the developing sleeve 51 to apply superimposed voltage thereto. Specifically, the superimposed voltage in which an AC component is superimposed on a DC component is applied to the base pipe 51*a*. When aluminum is used for the base pipe 51*a*, the nonmagnetic and conductive developing sleeve 51 is attained.

Next, descriptions are given below of image failure caused "ghost images" (also called "afterimages") caused by fluctuations in the amount of toner adhering to the latent image bearer.

In any of the development types, to attain full-color images that excel in color reproducibility, uniformity, and sharpness, it is preferred to make the amount of toner supplied to the image bearer, such as the photoconductor, conform to the electrostatic latent image.

It is known that fluctuations in the amount of toner adhering to the latent image bearer are caused by, in addition to fluctuations in the amount of toner change, an inheritance of image history from a preceding image to a subsequent image.

In hybrid development, which has been proposed in addition to one-component development and two-component development, the amount of toner on a toner bearer changes in accordance with a toner consumption pattern of an immediately preceding image, and the image density of a subsequent image tends to fluctuate. This is caused because the amount of toner supplied to the toner bearer is kept identical or similar constantly in hybrid development, the amount of toner on the toner bearer varies depending on the number of times toner is supplied to the toner bearer. That is, in a case where the toner consumption amount of the preceding image is small, the amount of toner remaining on the toner bearer is greater. The amount of toner on the toner bearer further increases after toner is supplied thereto, resulting in increases in image density. By contrast, after an image that consumes a greater amount of toner is printed, a smaller amount of toner remains on the toner bearer. It is possible that the amount of toner on the toner bearer is small even after toner is supplied thereto, resulting in decreases in image density.

By contrast, even in two-component developing devices, like the developing device 5 according to the present embodiment, it is possible that the subsequent image inherits the history of the preceding image and the image density becomes uneven, resulting in a ghost image. It is conceivable that ghost images in two-component developing devices are caused as follows.

That is, the development amount in the subsequent image depends on whether a given portion of the developing sleeve has faced a non-image area or an image area in the preceding image. This is a possible cause of a ghost image in the subsequent image.

Specifically, the non-image area has a potential stronger in keeping away toner than the potential of the developing sleeve. Accordingly, when the surface of the developing sleeve faces the non-image area of the photoconductor in the development range during the development of the preceding image, force heading from the photoconductor toward the surface of the developing sleeve is exerted on the charged toner due to differences in electrical potential between the non-image area and the developing sleeve. Therefore, the toner in two-component developer carried on the surface of the developing sleeve moves toward a root side of the magnetic brush on the developing sleeve, that is, toward the surface of the developing sleeve. Then, a part of the toner contacts the surface of the developing sleeve and adheres thereto.

On the surface of the developing sleeve downstream from the development range in the direction in which the developing sleeve rotates, the magnetic field generator exerts magnetic force to separate carrier particles from the developing sleeve. At that time, although the toner adhering to the carrier generally moves away together with the carrier, the toner adhering to both the carrier and the surface of the developing sleeve remains on one of them that is greater in adhesion force with toner. Accordingly, in a case where the adhesion force of toner to the developing sleeve is greater, when the carrier moves away from the developing sleeve due to the repulsive magnetic force, the toner adhering to the surface of the developing sleeve does not move away together with the carrier but remains on the developing sleeve. Subsequently, when the surface of the developing sleeve reaches the developer supply position, two-component developer is supplied again to the surface of the developing sleeve on which toner remains.

In a state in which the charged toner adheres thereto, the surface potential of the developing sleeve is increased by an amount equivalent to the electrical charge of the toner, and the surface potential is shifted to the side of toner charge polarity. Additionally, in the development range, on the surface of the photoconductor carrying the latent image, toner adheres to an image area having an electrical potential shifted to the opposite polarity (in the present embodiment, positive) of the toner charge polarity from the electrical potential (i.e., a development potential) of the surface of the developing sleeve. Therefore, when the developing sleeve is supplied again with two-component developer and then faces the image area in the development range, the surface of the developing sleeve on which the charged toner remains has stronger force to move toner to the image area of the photoconductor than the surface on which no toner remains. This increases the amount of toner supplied to the image area of the photoconductor.

By contrast, in a case of the surface of the developing sleeve that faces the image area of the photoconductor in the development range in developing the preceding image, the toner on the developing sleeve moves away from the developing sleeve due to differences in electrical potential between the image area and the developing sleeve. That is, the toner moves to a tip side of the magnetic brush. In the development range, a part of the toner in two-component developer moves to the image area, that is, the electrostatic latent image, and develops it into a toner image. At that time, although some of the toner may remain unused in developing the electrostatic latent image, such toner rarely contacts and adheres to the developing sleeve since the toner is on the tip side of the magnetic brush in the development range. When the carrier moves away from the developing sleeve due to the repulsive magnetic force, most of the toner in two-component developer carried on the developing sleeve moves away from the developing sleeve together with the carrier. Then, almost no toner remains on the surface of the developing sleeve.

Subsequently, when the surface of the developing sleeve reaches the developer supply position, two-component developer is supplied to the surface of the developing sleeve on which almost no toner remains. The electrical potential of the surface of the developing sleeve to which almost no charged toner adheres is not shifted to the side of the toner charge polarity. When the developing sleeve is supplied again with two-component developer and then faces the image area in the development range, the surface of the developing sleeve has weaker force to move toner to the image area than the surface on which toner remains.

Thus, the surface of the developing sleeve that has faced the non-image area in the preceding image exerts stronger force to move toner to the image area of the subsequent image than the surface of the developing sleeve that has faced the image area in the preceding image. Consequently, depending on which area (the non-image area or the image area) the surface of the developing sleeve has faced in the preceding image, the amount of toner that adheres to the image area in the subsequent image differs, and the image density fluctuates. It is conceivable that such image density fluctuations result in ghost images.

When toner contacts the developing sleeve, non-electrostatic adhesion force between toner and carrier, and that between toner and developing sleeve decrease. At that time, when a work function of toner is close to that of the developing sleeve, which of the two (the developing sleeve or carrier) the toner adheres is stochastically determined. Additionally, when the work function of the developing sleeve is greater than that of toner, negative electrical charges of toner that is in contact with the developing sleeve is transferred to the developing sleeve, which is a phenomenon called contact electrification. Accordingly, image force between toner and the developing sleeve becomes weaker, and toner does not leave carrier (or adheres again to carrier).

In developing a white solid image (i.e., a blank image), since the developing sleeve faces the non-image area of the photoconductor in the development range, the developing sleeve is smeared with toner (i.e., the smeary sleeve) after developing the white solid image. Accordingly, the surface of the developing sleeve that has developed the white solid image tends to have a surface potential increased by an amount equivalent to the electrical charge of toner adhering to the developing sleeve and, when used in development, the amount of toner that adheres to the image area of the photoconductor (hereinafter "development amount") increases, thereby increasing the image density.

By contrast, in developing a solid image (i.e., a black solid image), the development field that causes toner to move to the photoconductor is generated in the development range. Then, during the development, toner having normal electrical charges, out of smear of toner adhering to the developing sleeve, moves toward the photoconductor. Consequently, after developing the solid image, the developing sleeve is not smeared with toner.

When the solid image is continuously developed in this state, the smear of toner adhering to the developing sleeve is removed while the developing sleeve makes one revolution. Accordingly, after the formation of the solid image, the increase in the developing bias equivalent to the smear of toner on the developing sleeve is canceled, and the development amount returns to an ordinal amount (reduced from the increased state by the non-image area). The above-described processes arise in developing the black solid image following the development of the white solid image or in developing the black solid image immediately after an interval between sheets. Accordingly, the image density increases in a distance by which a leading end of the solid image goes round on the circumference of the developing sleeve.

A conceivable approach to inhibit ghost images is to provide a low friction film including, for example, tetrahedral amorphous carbon (ta-C) on the surface of the developing sleeve. The low friction film can inhibit toner from remaining on the developing sleeve, thereby inhibiting the occurrence of ghost images.

In the developing device 5, since the surface of the developing sleeve 51 is coated with the low friction film 51*b*, the occurrence of ghost images can be suppressed. However, it may be difficult to make the thickness of the low friction film 51*b* uniform, and it is possible that the low friction film 51*b* has unevenness in thickness. The thickness unevenness can result in cyclic density unevenness. It is conceivable that the density unevenness is caused as follows.

Figure 22A:
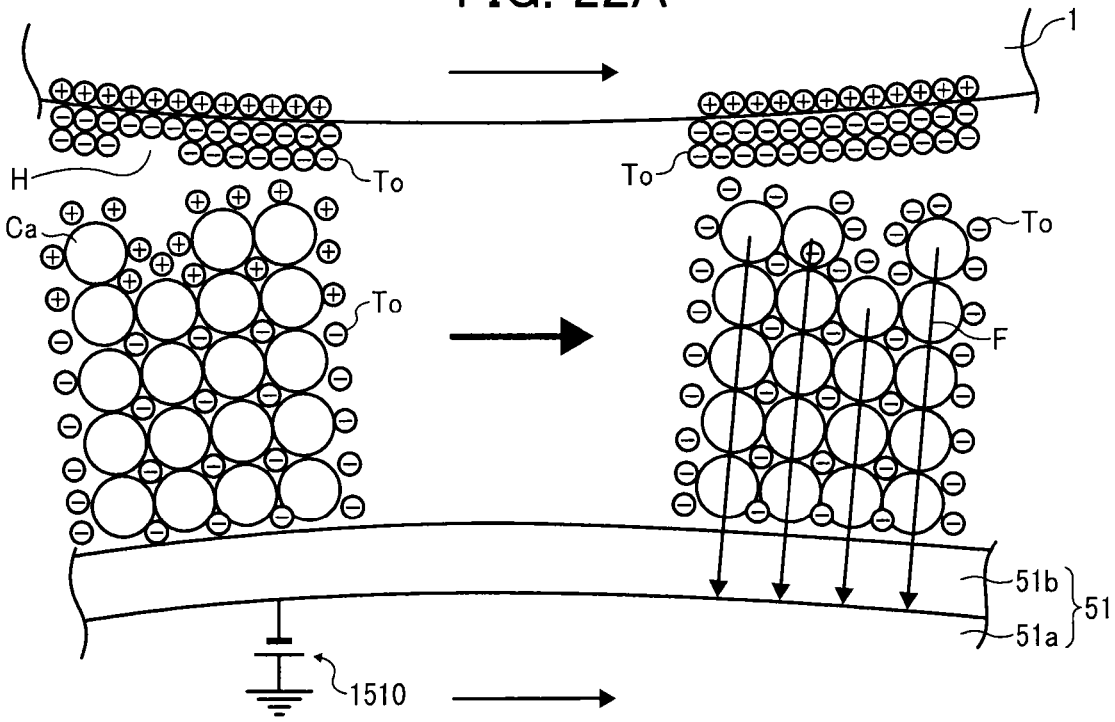
FIGS. 22A and 22B are schematic views illustrating development ranges and adjacent areas for understanding of a presumed mechanism how density unevenness is caused by thickness unevenness of a low friction film.
Figure 22B:
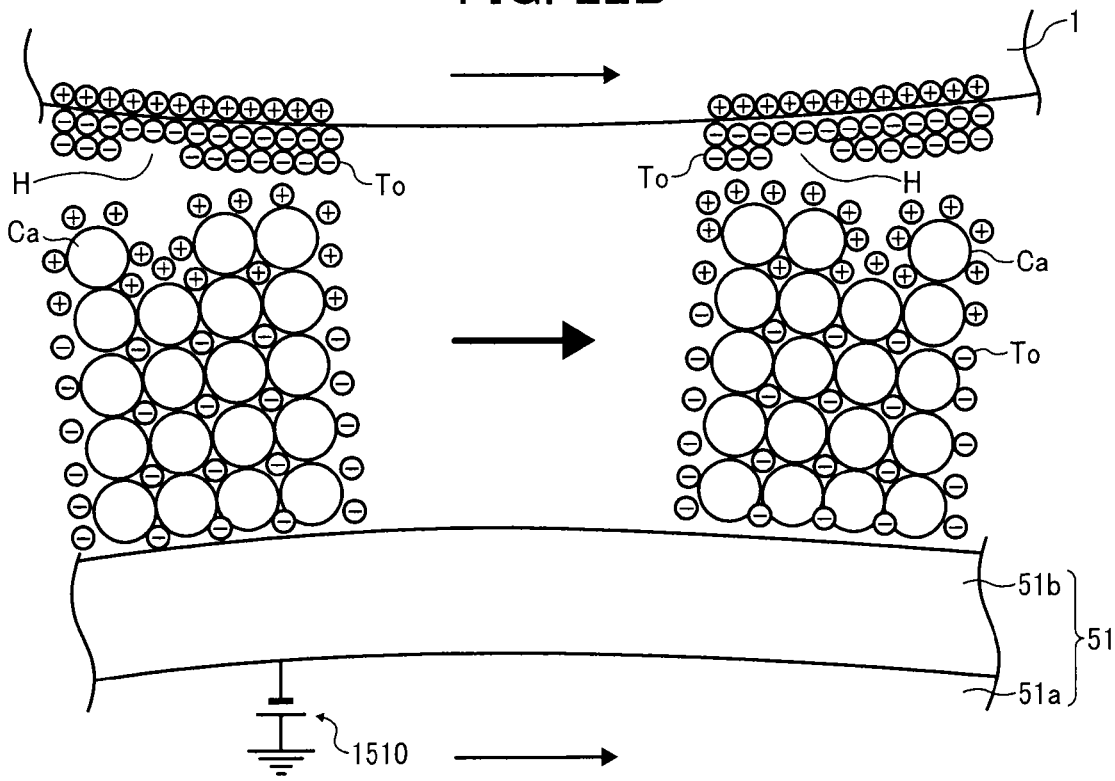

FIGS. 22A and 22B are schematic views illustrating development ranges and adjacent areas for understanding of a presumed mechanism how density unevenness is caused by the thickness unevenness of the low friction film 51*b*. FIG. 22A illustrates a configuration in which the low friction film 51*b* is thinner, and FIG. 22B illustrates a configuration in which the low friction film 51*b* is thicker.

In FIGS. 22A and 22B, the photoconductor 1 and the developing sleeve 51 move from the left to the right, reference character Ca represents carrier particles, and reference character To represents toner particles. As shown in FIGS. 22A and 22B, on the surface of the developing sleeve 51 adjacent to the development range, the carrier particles Ca in two-component developer are in the form of the magnetic brush, and the toner particles To adhere to the magnetic brush. In FIGS. 22A and 22B, symbols "−" and "+" in the toner particles To mean that the toner particles have the negative polarity charges (hereinafter simply "negative charges") and have positive polarity charges (hereinafter simply "positive charges"), respectively. Additionally, in the configurations shown in FIGS. 22A and 22B, a power source 1510 applies, as a developing bias, not the superimposed voltage but the DC component only to the base pipe 51*a*.

In FIGS. 22A and 22B, although clearance is present between the magnetic brush on the upstream side (on the left in these drawings) and the magnetic brush on the downstream side (on the right in these drawings) in the direction in which the developing sleeve 51 rotates, the magnetic brush in practice extends entirely in the developing sleeve 51 adjacent to the development range, and no clearance is present between the upstream side and the downstream side.

In the configurations shown in FIGS. 22A and 22B, the image area on the photoconductor 1 is charged to the positive side of the surface potential of the developing sleeve 51, and a part of the toner particles To adhering to the magnetic brush moves and adheres to the photoconductor 1 due to the potential difference with the developing sleeve 51.

At that time, since the negatively charged toner particles To leave the magnetic brush, as in the magnetic brushes on the left in FIGS. 22A and 22B, the positive charges equivalent to counter charges remain on the magnetic brush.

In two-component development typically used, when the amount of charge of the image area (an exposed portion) on the photoconductor 1 is balanced (in equilibrium) with the amount of charge on the side of the developing sleeve 51 including the counter charges remaining on the magnetic brush, the toner particles To stop moving, and development completes.

However, development can be still feasible if the positive charges equivalent to the counter charges are transferred toward the base pipe 51*a* as indicated by arrow F shown in FIG. 22A.

The low friction film 51*b* made of or including tetrahedral amorphous carbon or the like has an electrical resistance greater than that of the base pipe 51*a* made of or including metal such as aluminum. Accordingly, as the low friction film 51*b* becomes thinner, it is easier for the positive charges to move toward the base pipe 51*a*.

Reference character H in FIGS. 22A and 22B represents portions where the amount of toner particles To adhering thereto does not yet reach a predetermined amount although the potential of the image area is capable of attracting more toner particles To.

Such portions H where the amount of toner particles To is insufficient result in light density portions, in which the image density is lighter than in other image areas.

As in the configuration shown in FIG. 22A, when the low friction film 51*b* is thinner, the positive charges equivalent to the counter charges can move to the base pipe 51*a*. Accordingly, as in the magnetic brush on the left in FIG. 22A, even when the charge amount is temporarily balanced, development can be still feasible for an amount of the positive charges that move to the base pipe 51*a*, out of the positive charges equivalent to the counter charges. Then, the image area, such as the portion H in FIG. 22A, where the amount of toner particles To adhering thereto is insufficient, can be filled with the toner particles To. It can inhibit generation of the light density portions where the image density is lighter than other portions.

As an example of the thinner low friction film 51*b*, when a tetrahedral amorphous carbon (ta-C) layer of about 0.1 μm is used, it takes about 0.7 msec (i.e., a transit time) for the positive charges equivalent to the counter charges to move to the base pipe 51*a*. This transit time (about 0.7 msec in this example) is not greater than a period of time for a given position on the surface of the developing sleeve 51 to pass through the development range (i.e., a developing nip), which is about 7 msec. Accordingly, while the given position of the developing sleeve 51 passes through the development range, the positive charges equivalent to the counter charges can be transferred to the base pipe 51*a*, and development becomes feasible for the time equivalent to the positive charges thus transferred. Then, the image area where the amount of the toner particles To adhering thereto is insufficient can be filled with the toner particles To, thus inhibiting generation of the light density portions.

By contrast, as in the configuration shown in FIG. 22B, when the low friction film 51*b* is thicker, the positive charges equivalent to the counter charges rarely move to the base pipe 51*a*. Accordingly, as in the magnetic brush on the left in FIG. 22B, when the charge amount is balanced, the positive charges equivalent to the counter charges rarely move to the base pipe 51*a*, and thus development is not feasible. Then, when the charge amount is balanced, the image area, such as the portion H in FIG. 22B, where the amount of toner particles To adhering thereto is insufficient, is kept as is, thus generating the light density portions.

As an example of the thicker low friction film 51*b*, when a ta-C layer of about 0.6 □m is used, it takes about 70 sec for the positive charges equivalent to the counter charges to move to the base pipe 51*a*. This transit time (about 70 sec in this example) is greater than a period of time for a given position on the surface of the developing sleeve 51 to pass through the development range (i.e., the developing nip), which is about 7 msec. Accordingly, the transfer of the positive charges equivalent to the counter charges to the base pipe 51*a* does not complete while the given position of the developing sleeve 51 passes through the development range, and the portion H where the amount of the toner particles To adhering thereto is insufficient results in the light density portion.

As explained above with reference to FIGS. 22A and 22B, a portion where the low friction film 51*b* is thinner is less likely to cause the light density portion, and a portion where the low friction film 51*b* is thicker is likely to cause the light density portion. Since the portion of the thicker low friction film 51*b* reduce the image density, cyclic density unevenness corresponding to the unevenness in the layer thickness is caused.

It is to be noted that the development gap, which is a clearance between the developing sleeve 51 and the photoconductor 1, may be caused to fluctuate by the unevenness in the layer thickness of the low friction film 51*b* that is the surface layer of the developing sleeve 51. However, in the developing device 5 according to the present embodiment, the low friction film 51*b* is a deposition layer in nano order, and the unevenness in the layer thickness is about one tenth of several micrometers (μm). Since the development gap is about 0.2 mm (=200 μm), it can be deemed that fluctuations in the development gap resulting from the unevenness in the layer thickness rarely affect the image density unevenness.

In the configuration shown in FIGS. 22A and 22B, in which the developing bias include the DC component only (i.e., DC bias development), saturation development is difficult.

The term "saturation development" used here means a state in which the development field generated by the potential difference between the electrostatic latent image on the latent image bearer (i.e., the photoconductor 1) and the opposed electrode (i.e., the developing sleeve 51) is canceled by the toner electrical field, and thus the development field has no potential (0). In other words, it means a state in which the amount of toner adhering to the electrostatic latent image on the photoconductor 1 is sufficient and no more toner adheres thereto by the force of electrical field. If saturation development is difficult, there is a risk that the amount of toner adhering to the electrostatic latent image fluctuates due to changes in the development gap between the photoconductor 1 and the developing sleeve 51, and the image density is likely to fluctuate.

Photoconductors and developing rollers typical have runout tolerances and production tolerances, which cause the development gap to fluctuate, and the development amount fluctuates, thereby making the image density uneven. In particular, in the DC bias development, the toner adhesion amount is more susceptible to fluctuations in the development gap GP than that in the AC bias development. Thus, the image density increases as the development gap GP is reduced in size, and the image density decreases as the development gap GP is widened.

Figure 23:
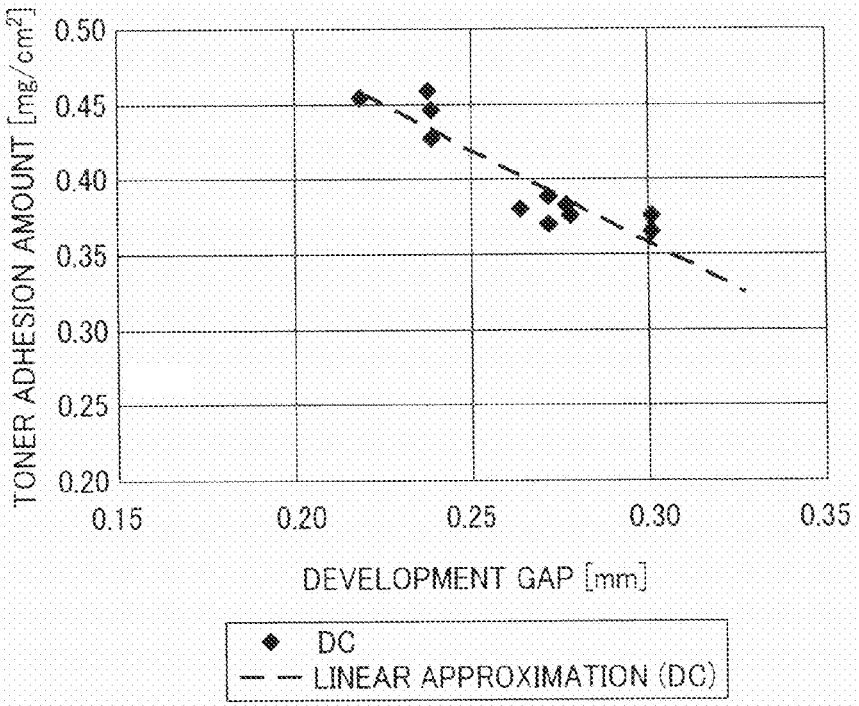
FIG. 23 is a graph illustrating the relation of toner adhesion amount and the development gap in the DC bias development.

FIG. 23 is a graph of the relation between the development gap GP and the toner adhesion amount, which is the amount of toner per unit area (developed area) on the photoconductor 1), in image formation under the following test conditions. In FIG. 23, the results obtained with the DC developing bias are plotted with diamonds, and the plotted diamonds are approximated to broken straight lines.

The results shown in FIG. 23 were obtained under the following experiment conditions.

Apparatus used: RICOH Pro C751EX;

Developing device used: Developing device for black;

Percentage of toner in developer: 7%

Developing potential (difference between the developing bias and potential in image portions on the photoconductor): 500 V According to the results in FIG. 23, even if the developing potential is identical, the toner adhesion amount decreases as the development gap increases. Thus, fluctuations in the development gap is one cause of image density unevenness.

Figure 24:
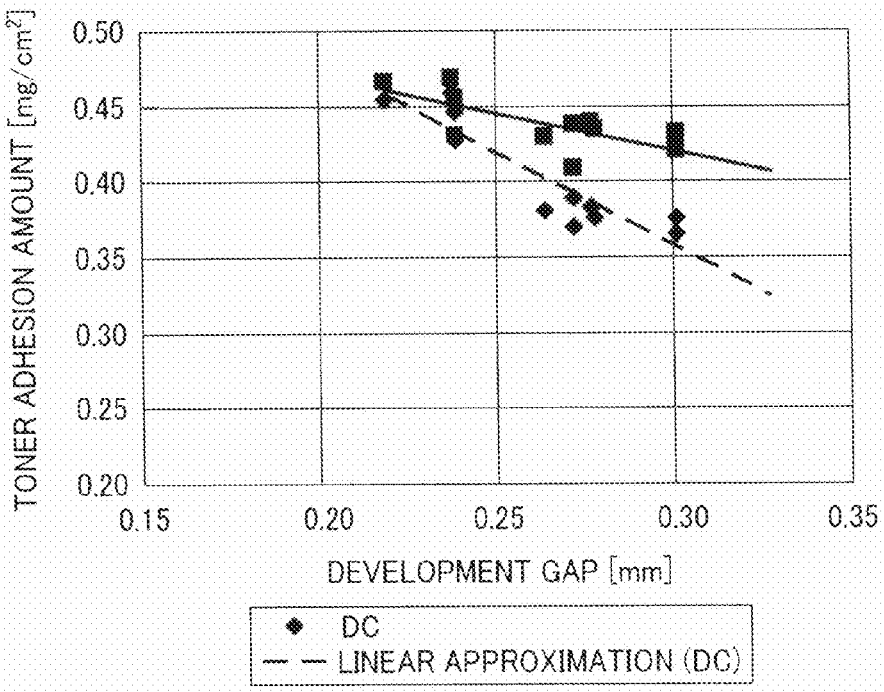
FIG. 24 is a graph that shows, in addition to the graph in FIG. 23, the relation of the development gap and the toner adhesion amount in image formation employing an AC developing bias having a smaller positive-side duty ratio.

FIG. 24 is a graph that shows, in addition to the graph shown in FIG. 23, the relation of the development gap GP and the toner adhesion amount in image formation employing the above-described RP developing bias, which is the AC developing bias having a smaller positive-side duty ratio. In FIG. 24, the results obtained with the RP developing bias are plotted with squares, and the plotted squares are approximated to a solid straight line. As shown in FIG. 24, in the RP development, fluctuations in toner adhesion amount due to fluctuations in the development gap GP is smaller in application of AC developing bias compared with application of AC developing bias.

The inventors of the present invention have found that development can be closer to saturation development in configurations in which the developing bias includes the AC component or the DC component superimposed with the AC component (i.e., AC bias development).

According to experiments to visualize development phenomena and considerations by the inventors, it is conceivable that the followings contribute to development closer to saturation development.

In two-component development, the carrier particles included in two-component developer carried on the developing sleeve stand on end and form the magnetic brush in the development range. Then, the carrier particles near the end of the magnetic blush contact the surface of the photoconductor. In DC bias development, toner particles that contribute to development are only those adhering to the carrier particles that contact the electrostatic latent image on the photoconductor. In other words, toner particles that are contactless with the surface of the photoconductor do not contribute to development.

By contrast, in AC bias development, the toner particles that contribute to development are not only those adhering to the carrier particles that contact the electrostatic latent image. The toner particles in an intermediate portion of the magnetic brush also leave the carrier particles due to the AC electrical field and contribute to development. Thus, in AC bias development, other toner particles than those in contact with the electrostatic latent image can be supplied to the electrostatic latent image. Accordingly, the developability, which is the amount of toner that contributes to development, is greater, and development closer to saturation development is feasible.

Additionally, the inventors of the present invention have found that, even in the configuration in which the low friction film 51*b* is provided on the developing sleeve 51, the cyclic image density unevenness corresponding to the thickness unevenness of the low friction film 51*b* can be suppressed using AC bias development, owing to the followings.

In DC bias development, if saturation development is not attained in the portion where the low friction film 51*b* is thinner, in the portion where the low friction film 51*b* is thicker and the developability is reduced, the amount of toner adhering to the image area decreases by an amount corresponding to the reduction in developability. Thus, the image density decreases. By contrast, if saturation development or close thereto is attained in the portion where the low friction film 51*b* is thinner owing to AC bias development, saturation development or close thereto can be maintained even in the portion where the low friction film 51*b* is thicker and the developability is reduced. Thus, decreases in image density can be suppressed. Further, even if the developability is reduced to a degree incapable of maintaining saturation development, the decrease in the amount of toner adhering can be made smaller than the reduction in developability, and decreases in image density can be suppressed.

Thus, the cyclic image density unevenness corresponding to the thickness unevenness of the low friction film 51*b* can be suppressed since decreases in image density in the portion where the low friction film 51*b* is thicker can be suppressed.

In the developing device 5 according to the present embodiment, since the developing sleeve 51 is provided with the low friction film 51*b* lower in friction coefficient with toner than the base pipe 51*a* including or made of, for example, aluminum as shown in FIG. 21, the occurrence of ghost images caused by smear on sleeve can be suppressed. Additionally, as shown in FIG. 4, development close to saturation development can be attained by applying the voltage in which the DC component is superimposed with the AC component. Accordingly, even if development conditions fluctuate to a certain degree due to fluctuations in thickness of the low friction film 51*b*, fluctuations in image density can be suppressed. Therefore, while inhibiting the occurrence of ghost images, image density unevenness resulting from fluctuations in thickness of the low friction film 51*b* can be suppressed.

By the way, to balance improvement of dot reproducibility and reduction of fog, an alternating voltage may be applied to the developing sleeve such that a first peak-to-peak voltage alternates with a second peak-to-peak voltage lower than the first peak-to-peak voltage.

[Experiment 4]

Experiment 4 was conducted to ascertain the advantage of use of the DC bias development in the developing device 5K and use of the RP development in other developing devices 5.

Configurations used in experiment 4 include configuration 1 that employs the DC bias development, black developer, and the low friction film; configuration 2 that employs the RP development, cyan developer, and the low friction film; and comparative examples 1 to 6. In these configurations, the occurrence of ghost images (also called "afterimages") and image density unevenness were evaluated.

In experiment 4, a commercially available digital full-color copier, imagio MP C5000 from Ricoh Co., Ltd, was modified to install a developing device different in development conditions, and images produced thereby were evaluated. As the development conditions, relative to the developing device 5 shown in FIG. 4, the presence of the low friction film 51*b* and combination of applied voltage were different.

(Evaluation of Ghost Images)

Figure 25:
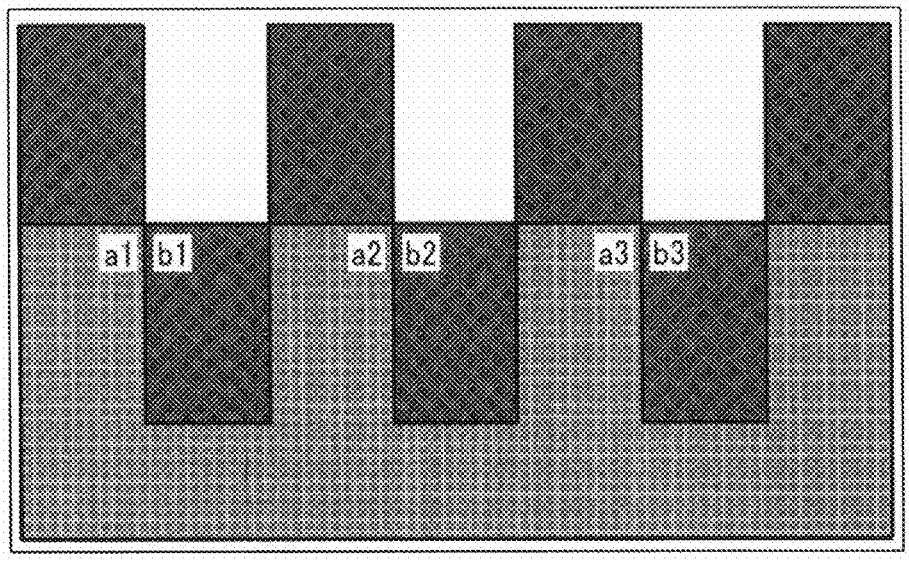
FIG. 25 is a conceptual diagram illustrating the occurrence of ghost images.

FIG. 25 is a conceptual diagram for understanding of occurrence of ghost images.

Regarding ghost images, after printing a chart having an image area ratio (also called "image coverage ratio") of 5% on 20 sheets (k sheets), an evaluation image for ghost image evaluation was printed. As the ghost image rating is based on differences in image density between an image (a) corresponding to a first revolution of the developing sleeve 51 and an image (b) corresponding to a subsequent revolution of the developing sleeve 51. Specifically, differences in image density between the image (a) and the image (b) were measured using an X-Rite densitometer (X-Rite 939), and a mean density difference ΔID of three positions (b1-a1, b2-a2, and b3-a3) was rated in the following four ratings of "excellent", "good", "acceptable", and "poor". The rating of "poor" is not acceptable and deemed failure.

Excellent: ΔID≤0.01,

Good: 0.01<ΔID≤0.03,

Acceptable: 0.03<ΔID≤0.06, and

Poor: ΔID>0.06

According to the above-described evaluation method, ghost image evaluation was made.

<Image Density Unevenness Evaluation>

An A3-size single color (cyan) image having an image area ratio of 75% was printed, and lightness deviation (highest lightness−lowest lightness) within the image was measured using the X-Rite densitometer (X-Rite 939). As ratings of image density unevenness, the lightness deviation less than 2.0 was rated "good" (no problem), and the lightness deviation equal to or greater than 2.0 was results was rated "poor" (image density was uneven).

It is to be noted that the apparatus used in experiment 4 is a modification of Ricoh imagio MP C5000 and common to configurations 1 and 2 and comparative examples 1 through 6. Black developer was used in configuration 1 and comparative examples 1 to 3, and cyan developer was used in configuration 2 and comparative examples 4 to 6.

Comparative Example 1

In comparative example 1, the DC developing bias was applied to an aluminum developing sleeve without the low friction film 51*b*. That is, the developing bias included only the DC component.

Conditions of comparative example 1 are as follows.

Developing sleeve: Aluminum sleeve; and

Developing bias: DC developing bias

Comparative Example 2

In comparative example 1, an aluminum developing sleeve without the low friction film 51*b* was used, and the AC developing bias, in which the AC component was superimposed on the DC component, was applied to the developing sleeve.

Conditions of comparative example 2 are as follows.

Developing sleeve: Aluminum sleeve; and

Developing bias: AC developing bias

Frequency: 1 kHz

Peak-to-peak value: 1000 V;

Positive-side duty ratio: 4%;

DC component voltage (offset): −230 V

The term "positive-side duty ratio" means a ratio of a positive side component in a single cycle of a developing bias that includes an AC component fluctuating cyclically. In other words, it is a ratio of time during which the developing bias is on the positive side from the DC component of −230 V in one cycle period of fluctuations in the developing bias.

Comparative Example 3

In comparative example 3, an aluminum developing sleeve coated with ta-C was used, and the AC developing bias, in which the AC component was superimposed on the DC component, was applied to the developing sleeve. That is, the developing sleeve 51 including the low friction film 51*b* was used in the AC bias development.

Conditions of comparative example 3 are as follows.

Developing sleeve: Aluminum sleeve coated with ta-C (0.6 μm with deviation of 0.3 μm) and Developing bias: AC developing bias Frequency: 1 kHz Peak-to-peak value: 1000 V;

Positive-side duty ratio: 4%;

DC component voltage (offset): −230 V (Configuration 1)

In configuration 1, the developing sleeve 51 including the base pipe 51*a* and the low friction film 51*b* (with ta-C coating) was used, and the DC developing bias was applied to the developing sleeve 51.

Conditions of configuration 1 are as follows.

Developing sleeve: Aluminum sleeve coated with ta-C (0.6 μm with deviation of 0.3 μm); and Developing bias: DC developing bias Comparative Example 4

In comparative example 4, the DC developing bias was applied to an aluminum developing sleeve without the low friction film 51*b*. That is, the developing bias included the DC component only.

Conditions of comparative example 1 are as follows.

Developing sleeve: Aluminum sleeve; and

Developing bias: DC developing bias

Comparative Example 5

In comparative example 5, an aluminum developing sleeve without the low friction film 51*b* was used, and the AC developing bias, in which the AC component was superimposed on the DC component, was applied to the developing sleeve.

Conditions of comparative example 5 are as follows.

Developing sleeve: Aluminum sleeve; and

Developing bias: AC developing bias

Frequency: 1 kHz

Peak-to-peak value: 1000 V;

Positive-side duty ratio: 4%;

DC component voltage (offset): −230 V

Comparative Example 6

In comparative example 6, the developing sleeve 51 including the base pipe 51*a* and the low friction film 51*b* (ta-C coating) was used, and the DC developing bias was applied to the developing sleeve 51.

Conditions of configuration 6 are as follows.

Developing sleeve: Aluminum sleeve coated with ta-C (0.6 μm with deviation of 0.3 μm); and Developing bias: DC developing bias (Configuration 2)

In configuration 2, an aluminum developing sleeve coated with ta-C was used, and the AC developing bias, in which the AC component was superimposed on the DC component, was applied to the developing sleeve. That is, the developing sleeve 51 including the low friction film 51*b* was used in the AC bias development.

Conditions of configuration 2 are as follows.

Developer: Cyan developer;

Developing sleeve: Aluminum sleeve coated with ta-C (0.6 μM with deviation of 0.3 μm); and Developing bias: AC developing bias Frequency: 1 kHz Peak-to-peak value: 1000 V;

Positive-side duty ratio: 4%; DC component voltage (offset): −230 V

Tables 1 and 2 show the results of experiment 4. It is to be noted that, in the columns of image density unevenness and graininess in Tables 1 and 2, parenthesize numerals represent the ratings. Additionally, in Tables 1 and 2, configurations 1 and 2 are represented by "E1" and "E2", and comparative examples 2 through 6 are represented by "C1" through "C6", respectively.

TABLE 1

| | Developer/ Sleeve material | LOW FRICTION FILM | FRICTION COEFFICIENT | DEVELOPING BIAS | GHOST IMAGE | IMAGE DENSITY UNEVENNESS | Graininess |
|---|---|---|---|---|---|---|---|
| C1 | Black/ | None | 0.5 | DC | Poor | Good (3) | Good (5) |
| C2 | Aluminum | None | 0.5 | AC | Poor | Good (4) | Poor (2) |
| C3 | | ta-C (6 μm) | 0.15 | AC | Good | Good (3) | Poor (2) |
| E1 | | ta-C (6 μm) | 0.15 | DC | Good | Good (4) | Good (5) |

TABLE 2

| | Developer/ Sleeve material | LOW FRICTION FILM | FRICTION COEFFICIENT | DEVELOPING BIAS | GHOST IMAGE | IMAGE DENSITY UNEVENNESS | Graininess |
|---|---|---|---|---|---|---|---|
| C4 | Cyan/ | None | 0.5 | DC | Poor | Good (3) | Good (5) |
| C5 | Aluminum | None | 0.5 | AC | Poor | Good (4) | Poor (2) |
| C6 | | ta-C (6 μm) | 0.15 | DC | Good | Poor (2) | Good (5) |
| E2 | | ta-C (6 μm) | 0.15 | AC | Good | Good (4) | Good (4) |

According to Table 2, in the developing device 5C for cyan, ghost images, image density unevenness, and graininess are alleviated by providing the low friction film 51*b* on the developing sleeve 51 and applying the AC developing bias to the developing sleeve 51. Additionally, according to Table 1, in the developing device 5K for black, ghost images are inhibited, and image density unevenness and graininess are suppressed by providing the low friction film 51*b* on the developing sleeve 51 and applying the DC developing bias to the developing sleeve 51.

[Experiment 5]

Descriptions are given below of experiment 5 executed to confirm the relation between fluctuations in the low friction film 51*b* and fluctuations in image density under conditions of comparative example 6 and configuration 2 described above.

Figure 26A:
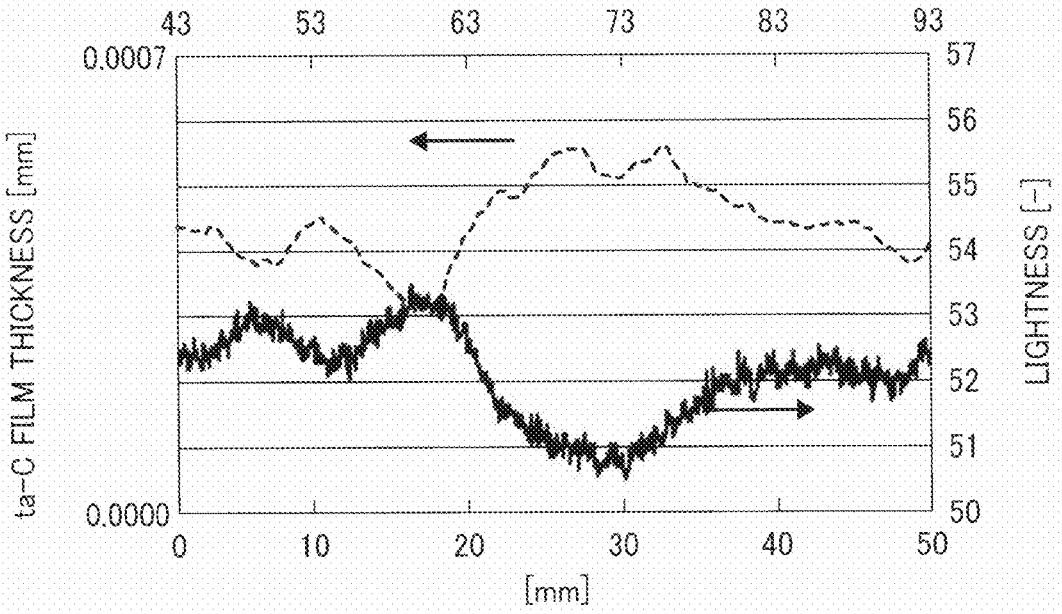
FIGS. 26A and 26B are graphs illustrating results of experiment 5.
Figure 26B:
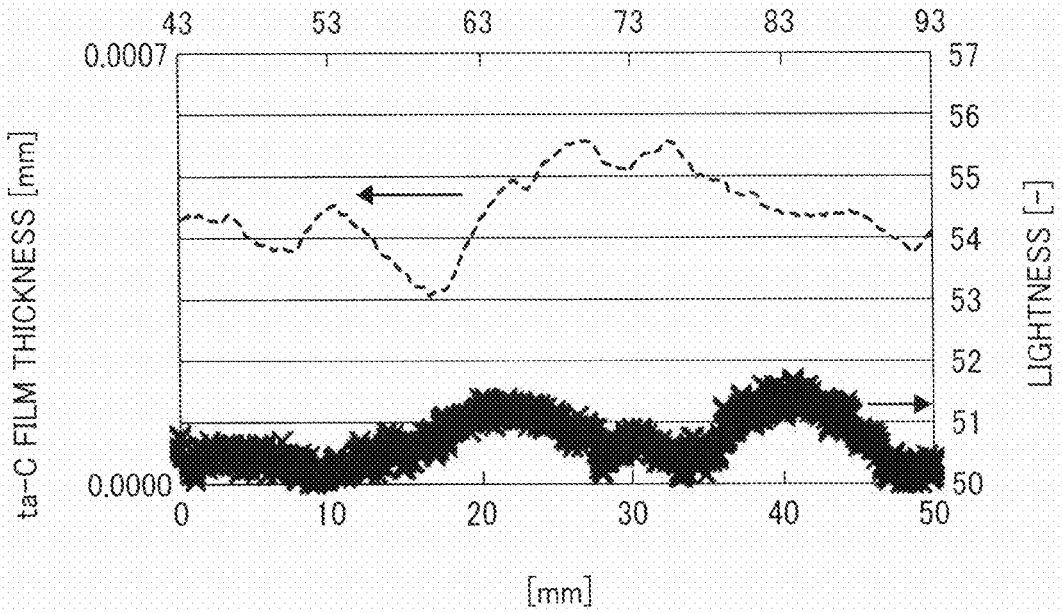

FIGS. 26A and 26B are graphs illustrating results of Experiment 5. The graphs illustrate fluctuations in thickness of the low friction film 51*b* for one revolution of the developing sleeve 51 and fluctuations in lightness in the direction of transport of a sheet bearing an image formed using the developing sleeve 51. FIG. 26A illustrates results of evaluation of comparative example 6, and FIG. 26B illustrates results of evaluation of configuration 2. In FIGS. 26A and 26B, broken lines represent the thickness of the low friction film 51*b*, and solid lines represent lightness of the image developed at the position corresponding to the thickness indicated by the broken lines. Fluctuations in lightness were measured on a halftone image (dot image) having an image area ratio of 75%.

The evaluation results of comparative example 2 shown in FIG. 26A show a correlation that lightness increases as the thickness of the low friction film 51*b* decreases. It is known, from the evaluation results of configuration 2 shown in FIG. 26B, that image density unevenness is alleviated by applying the developing bias including the AC component (i.e., an AC developing bias).

Causes of the above include the followings.

In the DC bias development using the DC developing bias, differences in thickness of the ta-C coating layer generate a portion (the low friction film 51*b* is thinner) where it is easy for the counter charges to escape and a portion (the low friction film 51*b* is thicker) where it is difficult. This is a conceivable reason why the thickness unevenness of the low friction film 51*b* makes the image density uneven.

By contrast, applying the AC developing bias can facilitate escape of the counter charges generated on the carrier, and development can be closer to saturation development than in DC bias development. Therefore, the thickness unevenness of the low friction film 51*b* is less likely to result in image density unevenness.

In the case of the AC developing bias, even when the resistance of developer or that of the developing roller is high, the electrical charges can easily move since a large electrical field is instantaneously acts thereon, compared with DC bias development. Thus, escape of the counter charges is facilitated. The following can be a cause why the AC developing bias can make development closer to saturation development. As described above with reference to FIGS. 22A and 22B, since the counter charges at the end of the magnetic brush escape, toner can easily go around to the end of the magnetic brush and be used in development.

An approach to inhibit image density unevenness, resulting from the thickness unevenness of the low friction film 51*b*, may be reduction in the thickness unevenness of the low friction film 51*b* itself. However, in an approach to reduce the thickness unevenness of the low friction film 51*b* to a degree capable of sufficiently inhibiting image density unevenness, yields decrease and the cost increases. Thus, it is not desirable.

<Formation of the Low Friction Film 51*b*>

As shown in FIG. 21, in the present embodiment, the developing sleeve 51 of the developing roller 50 is coated with the low friction film 51*b*.

The friction coefficient of the surface of the developing sleeve 51 can be lowered in the follow manner.

In the present embodiment, the low friction film 51*b* includes or is made of a ta-C film on the base pipe 51*a*, and the ta-C film is produced through filtered cathodic vacuum arc (FCVA).

As a brief description of formation of the ta-C film, put high purity carbon (graphite), as a target, in a substantially vacuum chamber, and subject the target to arc discharge. Using electromagnetic induction, guide plasma generated by the arc discharge to the base pipe 51*a* of the developing sleeve 51. During the electromagnetic induction, remove substances, such as macro particles, neutral atoms, molecules, and the like that are unnecessary for deposition by an electromagnetic spatial filter and extract ionized carbon only. Then, the ionized carbon that reaches the surface of the base material coagulates into a ta-C film.

Through the above-described processes, the low friction film 51*b* made of the ta-C film is formed on the base pipe 51*a*.

The low friction film 51*b* made of the ta-C film can be more uniform in thickness than films formed through plating or application. Further, since formable at a relatively low temperature, the ta-C film is less likely to be distorted by the temperature of the developing sleeve 51. Accordingly, the accuracy in shape of the developing sleeve 51 can be enhanced.

It is to be noted that, since deposition using FCVA is described in, for example, US patent publication No. 6,031,239(A) and widely used in practice, detailed descriptions thereof are omitted.

Alternatively, the low friction film 51*b* on the base pipe 51*a* may be made of or include a TiN film by hollow cathode discharge (HCD).

Through ion plating, which is a type of physical vapor deposition (PVD), a film that excels in adhesion can be produced relatively easily. Among ion plating methods, HCD is particularly advantageous in producing a coating that is homogeneous and uniform in thickness along a surface roughness of a base material.

It is to be noted that, since deposition using HCD is described in, for example, Japanese patent publication Nos. JP-H10-012431-A and JP-H08-286516-A and widely used in practice, detailed descriptions thereof are omitted.

The low friction film 51*b*, which is the surface layer of the developing sleeve 51, is a thin coating of a material, such as tetrahedral amorphous carbon (ta-C), titanium nitride (TiN), or the like, that is lower in friction coefficient with toner than the base pipe 51*a*.

Needless to say, as long as lower in friction coefficient with toner than the base pipe 51*a* and agreeable with effects of this specification, the material of the low friction film 51*b* is not limited to ta-C and TiN but can be other materials such as titanium carbide (TiC), titanium carbonitride (TiCN), molybdic acid, or the like.

It is to be noted that, according to the measurement of friction coefficient (with paper belt) described below, the friction coefficient of aluminum alloy is about 0.5 or greater, that of TiN is about 0.3 to 0.4, that of ta-C is about 0.1 or smaller.

<Measurement of Friction Coefficient>

The friction coefficients of the surfaces of the developing sleeve 51 coated with the low friction film 51*b* and the developing sleeve without the low friction film 51*b* were measured using Euler's belt theory.

Figure 27:
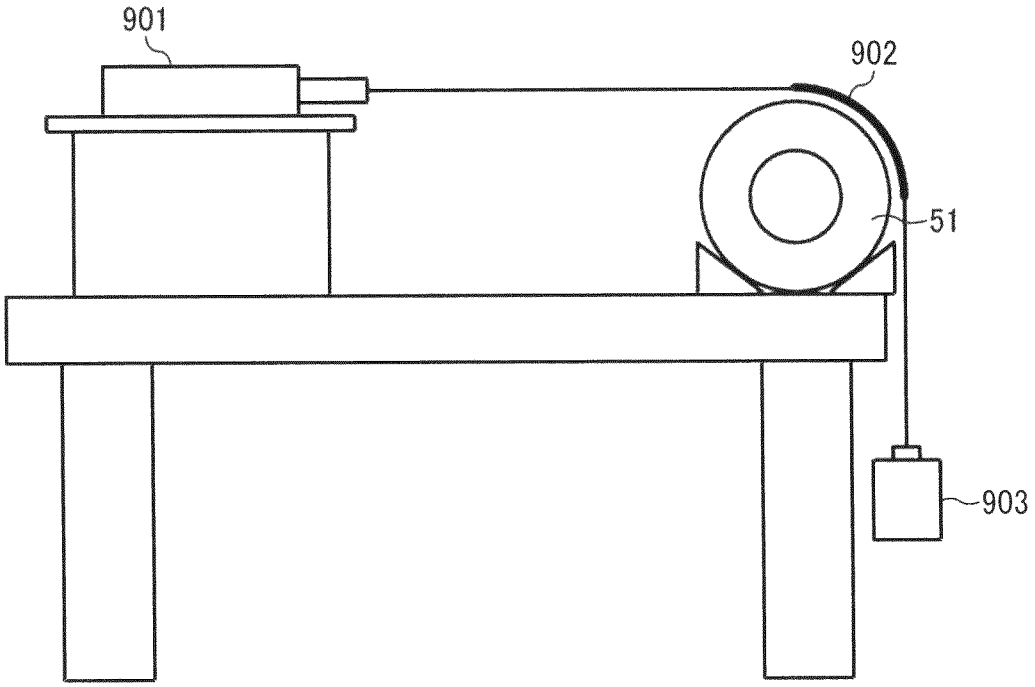
FIG. 27 is a schematic view illustrating a configuration of a friction coefficient measuring device.

FIG. 27 is a schematic view illustrating a configuration of a friction coefficient measuring device according to Euler's belt theory.

The measuring device shown in FIG. 27 includes a force gauge 901 (a digital push-pull gauge), a paper belt 902 made of fine paper of medium thickness, and a weight 903 (a load). The paper belt 902 is placed with a paper grain thereof in a longitudinal direction of the paper belt 902 and stretched one fourth of a circumference of the developing sleeve 51. The weight 903 weighs, for example, 0.98 N (100 grams) and is hung from one end of the belt 902, and the force gauge 901 is disposed at the other end of the paper belt 902.

In this configuration, while the force gauge 901 was pulled by the weight 903, a reading of load when the paper belt 902 moved was assigned in a formula of friction coefficient shown below:

$$\mu s = 2/\pi \times \ln(F/0.98)$$

wherein μ represents a stationary friction coefficient and F represents a measured value.

Ghost images can arise as follows. While the surface of the developing sleeve 51 passes through the development range, a greater amount of toner adheres to a surface that has faced a non-image area on the photoconductor 1 than a surface that has faced an image area on the photoconductor 1. Since the toner adhering to the developing sleeve 51 has electrical charges, when the surface of the developing sleeve 51 bearing toner again reaches the development range and performs image development, the development potential is increased by the charge amount of toner present on the surface of the developing sleeve 51. As the amount of toner adhering increases, the increase in charge amount increases, and the development amount increases. Accordingly, the development amount is greater in the portion developed by the surface of the developing sleeve 51 that has faced the non-image area in the preceding image, thus resulting in a ghost image.

By contrast, in the developing device 5 according to the present embodiment, the occurrence of ghost images can be suppressed by providing the low friction film 51*b* on the surface of the developing sleeve 51. With the developing sleeve 51 coated with the low friction film 51*b*, the adhesion force between toner and carrier can be greater than that between toner and the developing sleeve 51, and accordingly the amount of toner adhering to the developing sleeve 51 decreases. This can suppress the increase in surface potential of the developing sleeve 51 caused by the toner adhering thereto and accordingly inhibit the occurrence of ghost images.

The various aspects of the present specification can attain specific effects as follows.

Aspect A: A developing device includes a developer bearer, such as the developing roller 50, to carry, by rotation, developer including toner and magnetic carrier to a development range facing a latent image bearer, such as the photoconductor 1, and to supply the developer to a latent image on the latent image bearer. The developer bearer includes a magnetic field generator, such as the magnet roller 55, having multiple magnetic poles and a cylindrical developing sleeve, such as the developing sleeve 51, to contain the magnetic field generator, bear developer on an outer circumferential face thereof with magnetic force of the magnetic field generator, and rotate relative to a body of the device. The developing device is further provided with a voltage application device, such as the power source 151, to apply a developing bias to the developing sleeve. The voltage application device applies, to the developing sleeve, a voltage including an AC component having a frequency of about 2.0 kHz or lower, and, a duty ratio of an opposite polarity component, a polarity of which is opposite the toner normal charge polarity, of the development voltage is within a range from about 4% to about 20%.

According to aspect A, as described in the embodiment, compared with the DC bias development, the AC bias development is effective in reducing fluctuations in the amount of toner adhering to the latent image bearer. Accordingly, fluctuations in image density are reduced. Additionally, in the AC bias development in which the frequency is higher and the duty ratio of the opposite polarity component (opposite the toner normal charge polarity) is higher, the void at density boundaries is alleviated better than the DC bias development. By contrast, in the AC bias development in which the frequency is lower and the duty ratio of the opposite polarity component (opposite the toner normal charge polarity) is lower, the void at density boundaries is alleviated to a level similar to that attained by the DC bias without sacrificing the effect to reduce the density fluctuation. Specifically, the AC bias development in which the frequency is about 2.0 kHz or lower is advantageous in alleviating the void at density boundaries over the AC bias development in which the frequency is higher than 2.0 kHz. Although the graininess is degraded in the AC bias development in which the frequency is lower and the duty ratio of the opposite polarity component is higher, the degradation of graininess is inhibited in the AC bias development in which the frequency is lower and the duty ratio of the opposite polarity component is lower. Specifically, although the granularity tends to be degraded when the frequency is relatively low, the degradation of granularity is limited by reducing the time during which the potential difference to draw back toner to the developing sleeve is applied. Then, image formation is reliable without image failure.

Thus, according to aspect A, while the cyclic density fluctuation is inhibited, the occurrence of void at density boundaries and degradation of granularity are suppressed.

Aspect B: In aspect A, in the development voltage such as the developing bias, the difference between the largest value and the smallest value in the direction of the toner normal charge polarity is about 1500 V or smaller.

According to this aspect, background stains, which means the adhesion of toner to non-image areas, are inhibited as described above.

Aspect C: In aspect A or B, the developing sleeve includes a low friction surface layer, such as the low friction film 51*b*, made of a material lower in friction coefficient with toner than a material of a base, such as the base pipe 51*a*, that maintains the cylindrical shape of the developing sleeve.

As described above, providing the low friction surface layer can inhibit adhesion of toner to the developing sleeve. Accordingly, this configuration can inhibit the occurrence of ghost images resulting from the smeary sleeve. Additionally, the inventors have found that, compared with application of voltage including the DC component only, application of the voltage including the AC component can better inhibit fluctuations in developability caused by thickness unevenness of the low friction surface layer. Thus, this configuration can inhibit the occurrence of cyclic image density unevenness corresponding to the thickness unevenness of the low friction surface layer. Thus, aspect C can inhibit the occurrence of cyclic image density unevenness while inhibiting the occurrence of ghost images.

Aspect D: In aspect C, the low friction surface layer such as the low friction film 51*b* includes or is made of tetrahedral amorphous carbon.

With this configuration, as described above in the descriptions of embodiments, the developing sleeve includes the low friction surface layer.

Aspect E: In any of aspects A through D, the outer circumferential surface of the developing sleeve and the surface of the latent image bearer (such as the photoconductor 1) move in an identical direction in the development range, and the linear velocity ratio therebetween is expressed as $1.3 \leq Vs/Vg \leq 1.8$, wherein Vs represents the surface movement speed of the developing sleeve and Vg represents the surface movement speed of the latent image bearer.

According to this aspect, as described above, degradation of granularity is inhibited, thereby attaining reliable image formation with image failure suppressed.

Aspect F: An image forming apparatus, such as the image forming apparatus 500 shown in FIG. 2, includes the latent image bearer, a charging device to charge the surface of the latent image bearer, an exposure device to form an electrostatic latent image on the latent image bearer, and the developing device according to any of aspects A through E.

This configuration can inhibit the cyclic image density unevenness, the occurrence of void at density boundaries, and degradation of granularity and accordingly attain reliable image formation.

Aspect G: In aspect F, the image forming apparatus includes a black developing device (such as the developing device 5K) and a color developing device (such as the developing device 5C) for color other than black, the developing device according to any one of aspects A through E is used to as the color developing device, and the black developing device is different in configuration from the color developing device.

According to aspect G, in the color developing device, as described above, the occurrence of void at density boundaries and degradation of granularity are inhibited while inhibiting the cyclic image density unevenness. Accordingly, image formation can be reliable. Image density unevenness is less recognizable in black images. Accordingly, the black developing device uses development type, such as DC bias development, that is effective in suppressing the degradation of granularity through less effective in inhibiting image density unevenness to alleviate the void at density boundaries and granularity while alleviating the cyclic density fluctuation. With this configuration, since the occurrence of void at density boundaries and degradation of granularity are alleviated while alleviating the cyclic image density unevenness in both of the color developing device and the black developing device, multicolor images are formed reliably.

Aspect H: A process cartridge, such as the image forming unit 6, removably installed in an image forming apparatus, includes at least the latent image bearer, the developing device according to any of aspects A through E, and a common unit casing to house those components.

This configuration can inhibit the cyclic image density unevenness, the occurrence of void at density boundaries, and degradation of granularity and further facilitate replacement of the developing device. Additionally, in image forming apparatuses including multiple process cartridges that are independently replaceable, only the process cartridge that requires replacement is replaced. This configuration is effective in providing reliable images at a reduced cost for users.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to carry, by rotation, developer including toner and magnetic carrier to a development range facing a latent image bearer to bear a latent image, the developer bearer including:

a magnetic field generator having multiple magnetic poles; and a cylindrical developing sleeve to rotate and bear developer on an outer circumferential surface thereof with magnetic force of the magnetic field generator disposed inside the developing sleeve, the developer bearer to receive development voltage including an AC component having a frequency of 2.0 kHz or lower, the AC component in which a duty ratio of a component having a polarity opposite a toner normal charge polarity is within a range from 4% to 20%.

2. The developing device according to claim 1, wherein, in the development voltage, a difference between a largest value and a smallest value in a direction of the toner normal charge polarity is 1500 V or smaller.

3. The developing device according to claim 1, wherein the developing sleeve comprises:

a base to maintain a cylindrical shape of the developing sleeve; and a low friction surface layer lower in friction coefficient with toner than a material of the base.

4. The developing device according to claim 3, wherein the low friction surface layer comprises tetrahedral amorphous carbon.

5. The developing device according to claim 1, wherein the outer circumferential surface of the developing sleeve and a circumferential surface of the latent image bearer are to move in an identical direction in the development range, and when Vs represents a surface movement speed of the developing sleeve and Vg represents a surface movement speed of the latent image bearer, a linear velocity ratio therebetween is expressed as $1.3 \leq Vs/Vg \leq 1.8$.

6. A process cartridge removably installable in an image forming apparatus and comprising:

the latent image bearer;

the developing device according to claim 1; and a common unit casing to hold the latent image bearer and the developing device as a single unit.

7. An image forming apparatus comprising:

a latent image bearer to bear an electrostatic latent image thereon;

a charging device to charge a surface of the latent image bearer; and a developing device including:

a developer bearer to carry, by rotation, developer including toner and magnetic carrier to a development range facing the latent image bearer, the developer bearer including:

a magnetic field generator having multiple magnetic poles, and a cylindrical developing sleeve to rotate and bear developer on an outer circumferential surface thereof with magnetic force of the magnetic field generator disposed inside the developing sleeve; and a first voltage application device to apply, to the developer bearer, development voltage including an AC component having a frequency of 2.0 kHz or lower, the AC component in which a duty ratio of a component having a polarity opposite a toner normal charge polarity is within a range from 4% to 20%.

8. The image forming apparatus according to claim 7, wherein the developing device develops the latent image with developer other than black developer, and the image forming apparatus further comprises:

a black developing device to develop the latent image with black developer; and a second voltage application device to apply, to a developer bearer of the black developing device, development voltage different from the development voltage applied by the first voltage application device to the developer bearer of the developing device.

9. The developing device according to claim , wherein the development voltage is applied to the developing sleeve of the developer bearer.

10. A developing device comprising: p1 a developer bearer to carry, by rotation, developer including toner to a development range facing a latent image bearer to bear a latent image, the developer bearer including a cylindrical surface to rotate and bear developer on an outer circumferential surface thereof, the developer bearer to receive development voltage including an AC component having a frequency of 2.0 kHz or lower, the AC component in which a duty ratio of a component having a polarity opposite a toner normal charge polarity is within a range from 4%to20%.

11. The developing device according to claim 10, wherein, in the development voltage, a difference between a largest value and a smallest value in a direction of the toner normal charge polarity is 1500 V or smaller.

12. The developing device according to claim 10, wherein the outer circumferential surface of the developer bearer and a circumferential surface of the latent image bearer are to move in an identical direction in the development range, and when Vs represents a surface movement speed of the developer bearer and Vg represents a surface movement speed of the latent image bearer, a linear velocity ratio therebetween is expressed as $1.3 \leq Vs/Vg \leq 1.8$.

13. A process cartridge removably installable in an image forming apparatus and comprising:

the latent image bearer;

the developing device according to claim 10; and a common unit casing to hold the latent image bearer and the developing device as a single unit.

* * * * *